US010071021B2

(12) United States Patent
Calvert, II et al.

(10) Patent No.: US 10,071,021 B2
(45) Date of Patent: Sep. 11, 2018

(54) CAPSULE FILLING SYSTEMS AND METHODS OF USING A CAPSULE FILLING SYSTEM

(71) Applicant: Maxocap Corporation, Murrieta, CA (US)

(72) Inventors: Elbern Calvert, II, Murrieta, CA (US); Kelly Calvert, Murrieta, CA (US); Anthony DeMore, Willoughby, OH (US); Jess Carlson, Chagrin Falls, OH (US)

(73) Assignee: Maxocap Corporation, Murrieta, CA (US)

( * ) Notice: Subject to any disclaimer, the term of this patent is extended or adjusted under 35 U.S.C. 154(b) by 661 days.

(21) Appl. No.: 14/716,017

(22) Filed: May 19, 2015

(65) Prior Publication Data

US 2016/0338914 A1 Nov. 24, 2016

(51) Int. Cl.
*A61J 3/07* (2006.01)

(52) U.S. Cl.
CPC ..... *A61J 3/074* (2013.01)

(58) Field of Classification Search
CPC ... A61J 3/07; A61J 3/071; A61J 3/074; B65B 43/54; B65B 67/02
USPC ..... 53/235, 281, 390, 900
See application file for complete search history.

(56) References Cited

U.S. PATENT DOCUMENTS 326,578 A 9/1885 Merz
422,365 A 3/1890 Bateson
803,145 A 10/1905 Winchester
899,761 A 9/1908 Remington
1,064,568 A 6/1913 Toplis
1,092,319 A 4/1914 Winchester
1,155,023 A 9/1915 Winchester
1,567,639 A * 12/1925 Eastman ..... A61J 3/075 141/246
1,658,423 A 2/1928 Ware
1,839,820 A 1/1932 Wilkie
2,010,699 A 12/1932 Pattee
(Continued)

FOREIGN PATENT DOCUMENTS

EP 1719491 11/2006
EP 2561851 2/2013

*Primary Examiner* — Andrew M Tecco
*Assistant Examiner* — Nicholas Igbokwe
(74) *Attorney, Agent, or Firm* — Buchanan Van Tuinen LLC

(57) ABSTRACT

Capsule filling systems and methods of using a capsule filling system to fill one or more capsules are described herein. An example embodiment of a capsule filling system comprises a first housing, a first rotatable member, a second housing, a second rotatable member, a hinge, and a base. The first housing defines a first housing cavity and the second housing defines a second housing cavity. The first rotatable member is disposed within the first housing cavity. The second rotatable member is disposed within the second housing cavity. Movement of the first rotatable member between its first and second positions provides a mechanism for releasably attaching a first member of a capsule to the capsule filling system. Movement of the second rotatable member between its first and second positions provides a mechanism for releasably attaching a second member of a capsule to the capsule filling system.

20 Claims, 12 Drawing Sheets

(56) References Cited

U.S. PATENT DOCUMENTS

| | | | | | |
|---|---|---|---|---|---|
| 2,091,445 | A * | 8/1937 | Hirschle | B65B 67/02 | 141/246 |
| 2,322,169 | A | 6/1943 | Smith | | |
| 2,348,749 | A | 5/1944 | Norelli | | |
| 2,574,727 | A | 11/1951 | Burkett | | |
| 2,680,548 | A | 6/1954 | Karos | | |
| 2,762,181 | A | 9/1956 | Whitecar | | |
| 3,078,629 | A | 2/1963 | Besemer et al. | | |
| 3,269,429 | A * | 8/1966 | Fritts | A61J 3/075 | 141/133 |
| 3,552,095 | A | 1/1971 | Inman | | |
| 3,612,271 | A | 10/1971 | Behling | | |
| 4,163,354 | A | 8/1979 | Austin | | |
| 4,884,602 | A | 12/1989 | Yamamoto et al. | | |
| 5,010,929 | A | 4/1991 | Tisma | | |
| 5,081,822 | A | 1/1992 | Boyd et al. | | |
| 5,321,932 | A | 6/1994 | Sundberg | | |
| 5,660,029 | A | 8/1997 | King | | |
| 5,743,069 | A | 4/1998 | Ansaloni | | |
| 5,797,248 | A * | 8/1998 | Hetherington | A61J 3/075 | 141/247 |
| 5,836,141 | A | 11/1998 | Sundberg | | |
| 6,170,226 | B1 | 1/2001 | Chang | | |
| 6,508,279 | B2 | 1/2003 | Siegel et al. | | |
| 7,234,494 | B2 | 6/2007 | Tahil et al. | | |
| 7,337,596 | B2 | 3/2008 | Barrett et al. | | |
| 7,530,213 | B2 | 5/2009 | Barrett et al. | | |
| 7,937,907 | B2 | 5/2011 | Fleckenstein et al. | | |
| 7,971,765 | B2 | 7/2011 | Engle | | |
| 8,561,282 | B2 | 10/2013 | Hirota | | |
| 2004/0144066 | A1 | 7/2004 | Piemontese | | |
| 2005/0076969 | A1 * | 4/2005 | Tahil | A61J 3/075 | 141/165 |
| 2006/0064943 | A1 * | 3/2006 | Trebbi | A61J 3/074 | 53/454 |
| 2006/0248857 | A1 * | 11/2006 | Senesi | A61J 3/075 | 53/281 |
| 2007/0130890 | A1 * | 6/2007 | Barrett | A61J 3/075 | 53/468 |
| 2008/0210731 | A1 * | 9/2008 | Engle | A61J 3/075 | 225/1 |
| 2011/0139812 | A1 * | 6/2011 | Dagsland | B65B 1/363 | 141/237 |
| 2013/0014471 | A1 * | 1/2013 | Tahil | A61J 3/072 | 53/284.5 |
| 2013/0032246 | A1 * | 2/2013 | Tahil | A61J 3/075 | 141/98 |
| 2013/0192717 | A1 * | 8/2013 | Kuo | A61J 3/075 | 141/237 |
| 2013/0333801 | A1 * | 12/2013 | Gall | B65B 1/363 | 141/234 |

* cited by examiner

CAPSULE FILLING SYSTEMS AND METHODS OF USING A CAPSULE FILLING SYSTEM

FIELD

The disclosure relates generally to capsule filling systems and methods of using a capsule filling system.

BACKGROUND

Conventional capsules are manufactured in various sizes and shapes and generally include a capsule cap that is introduced into a capsule body, or vice versa. Capsules are generally oblong in shape, vary is size, and can be assembled using a variety of structures and methods. For example, a capsule cap can be telescopically fitted onto the capsule body such that a radially inward projecting ring defined by the capsule cap is introduced into a radial groove define by the capsule body. Alternatively, the capsule cap and capsule body can be configured such that a friction fit between the two components can be achieved when they are assembled. In either arrangement, the capsule cap is capable of being removed from the capsule body in order to introduce material, such as powder or a powdered mixture, into the capsule body. Subsequently, the capsule cap can be releasably attached to the capsule body to seal the material within the capsule such that the capsule can be used.

Various devices have been developed to introduce material into capsules. For example, large automated systems have been developed that disassemble a plurality of capsules, fill the capsule bodies, and reassemble the capsules. These devices, however, have multiple drawbacks such as requiring constant monitoring, being expensive to repair, and difficult to operate. Therefore, a need exists for improved capsule filling systems and methods of using a capsule filling system.

BRIEF SUMMARY OF SELECTED EXAMPLE EMBODIMENTS

An example embodiment of a capsule filling system for filling one or more capsules comprises a first housing, a first rotatable member, a second housing, a second rotatable member, and a base. The first housing defines a first housing cavity and a plurality of first housing passageways that extend through the first housing and provide access to the first housing cavity. The first rotatable member is disposed within the first housing cavity and is rotatably attached to the first housing. The first rotatable member defines a plurality of first rotatable member passageways that extend through the first rotatable member. The first rotatable member is moveable between a first position and a second position and is aligned with the first housing such that a first rotatable member passageway of the plurality of first rotatable member passageways is aligned with a first housing passageway of the plurality of first housing passageways to cooperatively define a first member passageway. The first member passageway has a first member passageway first diameter when the first rotatable member is in the first position and a first member passageway second diameter when the first rotatable member is in the second position. The first member passageway first diameter is greater than the first member passageway second diameter. The second housing is attached to the first housing and defines a second housing cavity and a plurality of second housing passageways that extend through the second housing and provide access to the second housing cavity. The second rotatable member is disposed within the second housing cavity and is rotatably attached to the second housing. The second rotatable member defines a plurality of second rotatable member passageways that extend through the second rotatable member. The second rotatable member is moveable between a first position and a second position and is aligned with the second housing such that a second rotatable member passageway of the plurality of second rotatable member passageways is aligned with a second housing passageway of the plurality of second housing passageways to cooperatively define a second member passageway. The second member passageway has a second member passageway first diameter when the second rotatable member is in the first position and a second member passageway second diameter when the second rotatable member is in the second position. The second member passageway first diameter is greater than the second member passageway second diameter. The base is attached to the second housing and is configured to prevent a capsule of the one or more capsules from passing through a passageway of the plurality of second housing passageways.

An example method of filling one or more capsules using a capsule filling system comprises the steps of: removing the lid from the first housing; confirming whether the first rotatable member is in the first position; confirming whether the second rotatable member is in the first position; moving the first housing to the second position; loading one or more capsules into the second member passageways; moving the first housing to the first position; moving the first rotatable member to the second position to releasably attach the first member of the one or more capsules to the first housing; moving the second rotatable member to the second position to releasably attach the second member of the one or more capsules to the second housing; moving the first housing to the second position; moving the second rotatable member to the first position such that the second member of the one or more capsules fall flush with the first surface of the third member of the second housing; introducing a material into one or more of the second member of the one or more capsules; moving the first housing to the first position; moving the base from the first position to the second position while the first member of the one or more capsules are releasably attached to the first housing such that the second member of the one or more capsules are advanced toward the first member of the one or more capsules and the first member becomes releasably attached to the second member; moving the base from the second position to the first position; moving the first rotatable member to the first position such that the one or more capsules are free of attachment to the first housing; rotating the capsule filling system such that the first surface of the first member is directed toward another surface; moving the base from the first position to the third position to remove any capsule of the one or more capsules remaining in the capsule filling system.

DETAILED DESCRIPTION

Figure 1:
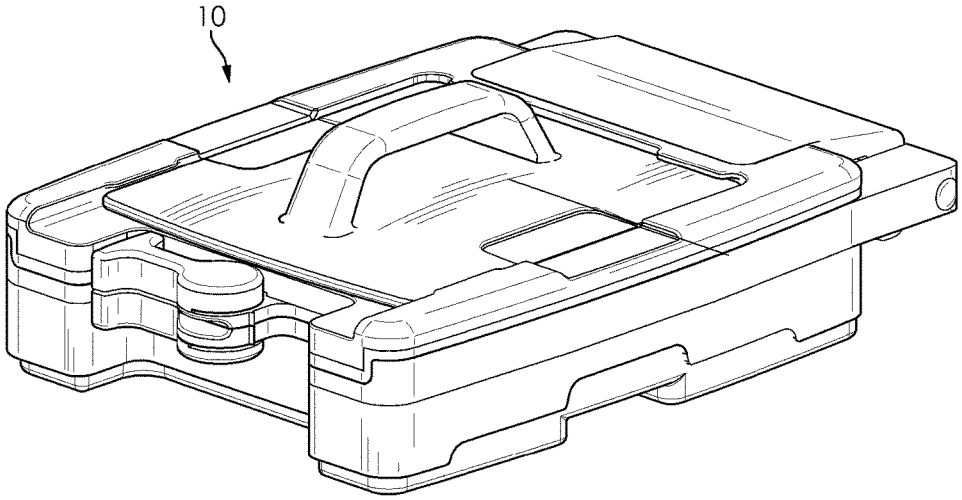
FIG. 1 is a perspective view of an example embodiment of a capsule filling system. The capsule filling system is in a closed configuration and the base is in a first position.
Figure 2:
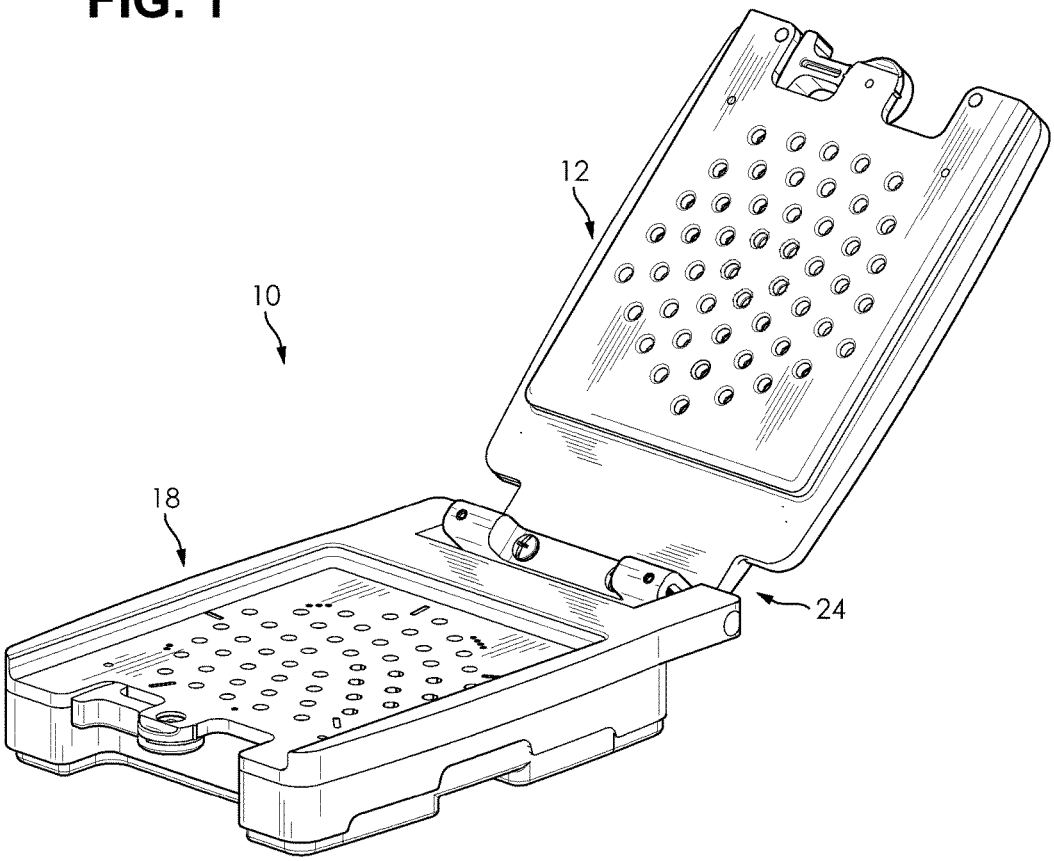
FIG. 2 is a perspective view of the capsule filling system illustrated in FIG. 1. The capsule filling system is in an open configuration.
Figure 3:
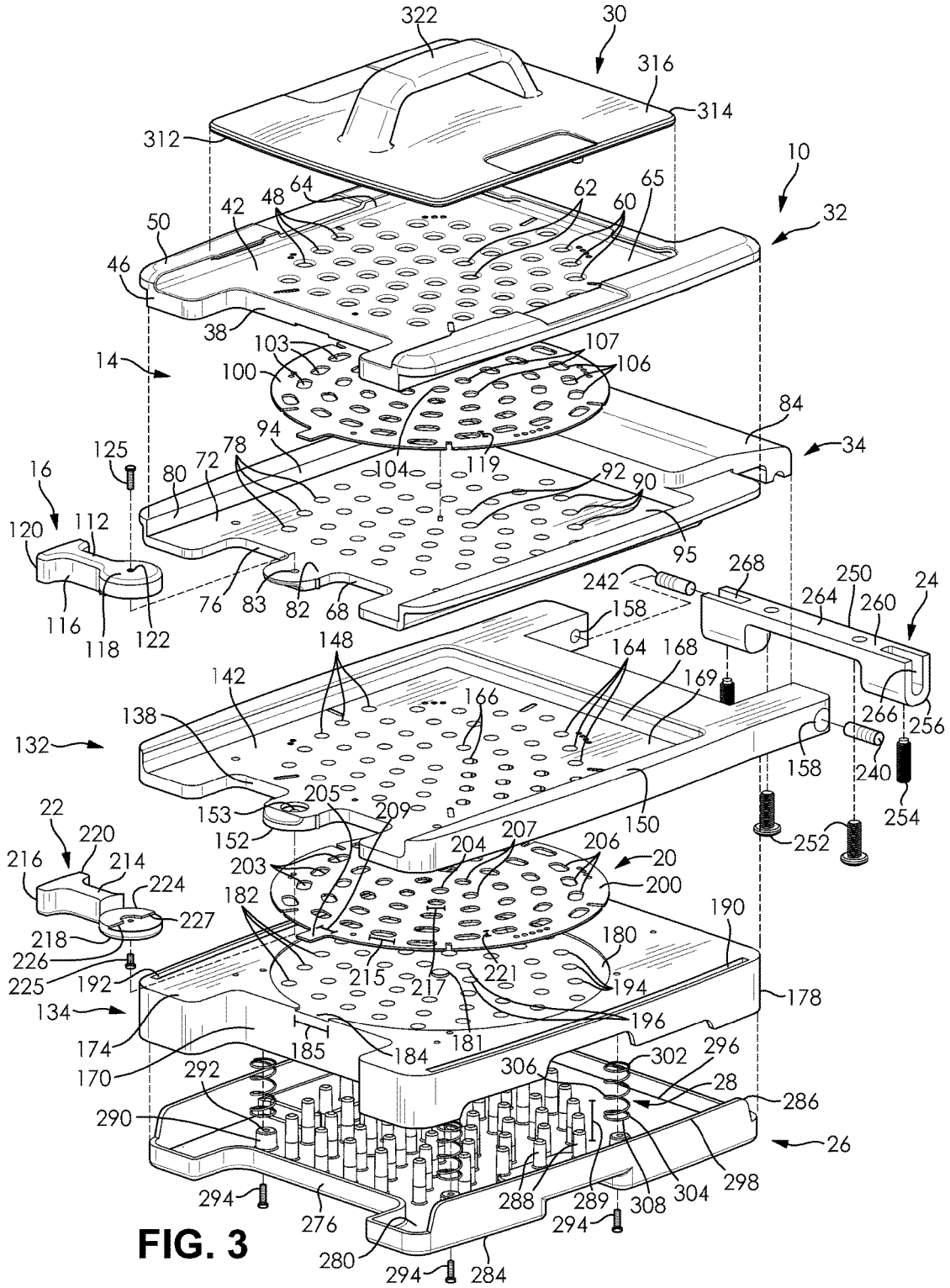
FIG. 3 is an exploded view of the capsule filling system illustrated in FIG. 1.
Figure 4:
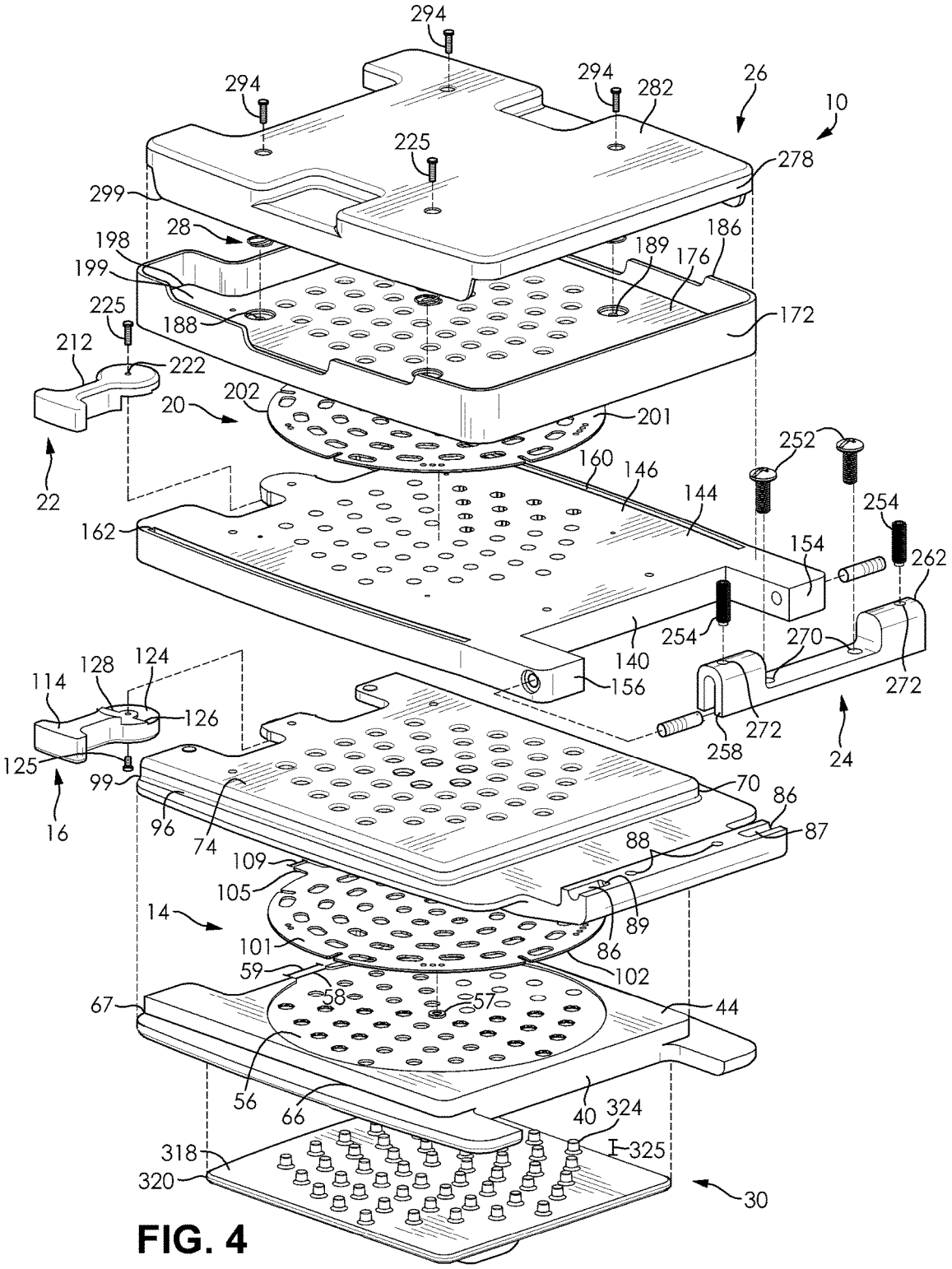
FIG. 4 is another exploded view of the capsule filling system illustrated in FIG. 1.

The following detailed description and the appended drawings describe and illustrate various example embodiments of capsule filling systems and methods of using a capsule filling system to fill one or more capsules. The description and illustration of these examples are provided to enable one skilled in the art to make and use a capsule filling system and to practice a method of using a capsule filling system to fill one or more capsules. They are not intended to limit the scope of the claims in any manner.

The use of "e.g.," "etc.," "for instance," "in example," and "or" and grammatically related terms indicate non-exclusive alternatives without limitation, unless otherwise noted. The use of "optionally" and grammatically related terms means that the subsequently described element, event, feature, or circumstance may or may not be present or occur, and that the description includes instances where said element, event, feature, or circumstance occurs and instances where it does not. The term "attached" refers to the fixed, releasable, or integrated association of two or more elements and/or devices. Thus, the term "attached" includes releasably attaching and fixedly attaching two or more elements and/or devices. The term "diameter" refers to the length of a straight line passing from side to side through the center of a body, element, or feature, and does not impart any structural configuration on the body, element, or feature. The term "material" refers to any fluid, gel, solid, powder, powdered mixture, and/or any other substance.

FIGS. 1, 2, 3, 4, 5, 6, 7, 8, and 9 illustrate an example embodiment of a capsule filling system 10 for filling one or more capsules. The capsule filling system 10 includes a first housing 12, a first rotatable member 14, a first actuator 16, a second housing 18, a second rotatable member 20, a second actuator 22, a hinge 24, a base 26, a plurality of springs 28, and a lid 30. The capsule filling system 10 is adapted to separate a first member of a capsule (e.g., capsule cap) from a second member of a capsule (e.g., capsule body) such that the second member can be filled and releasably attached to the first member, or vise versa.

Figure 9:
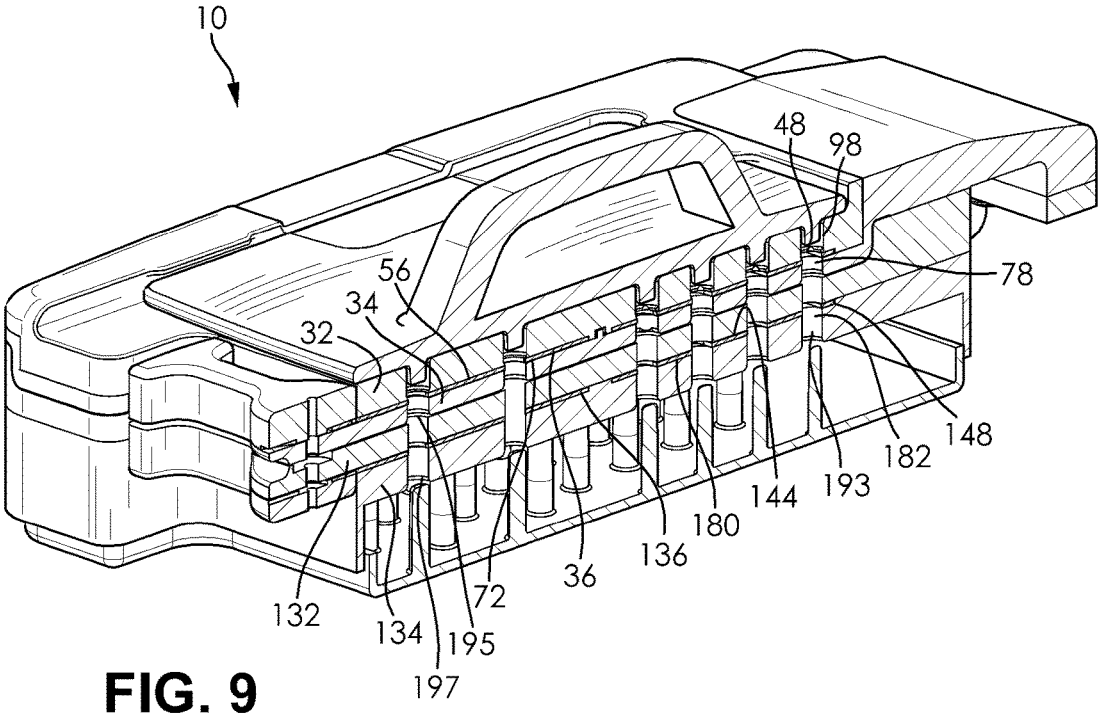
FIG. 9 is a cross-sectional view of the capsule filling system illustrated in FIG. 5, taken along line 9-9.

In the illustrated embodiment, the first housing 12 has a first member 32 and a second member 34 that cooperatively define a first housing cavity 36, as shown in FIG. 9. The first member 32 has a first end 38, a second end 40, a first surface 42, a second surface 44, and a body 46 that defines a plurality of passageways 48, a lip 50, a recess 56, and a notch 58. Each passageway of the plurality of passageways 48 extends from the first surface 42 to the second surface 44 and is sized and configured to receive a portion of a capsule. The plurality of passageways 48 are arranged such that a first set 60 of the plurality of passageways 48 is disposed relative to a second set 62 of the plurality of passageways 48. Each passageway in the first set 60 is positioned a first distance from an axis that extends through the first member 32 and each passageway in the second set 62 is positioned a second distance from the axis that extends through the first member 32 that is less than the second distance. The axis that extends through the first member is coaxial with an axis about which the first rotatable member 14 rotates, as described in more detail herein. The first set 60 has a first configuration and the second set 62 has a second configuration that is different than the first configuration.

In the illustrated embodiment, the lip 50 extends from the first surface 42 and away from the second surface 44 to define a first shoulder 64 and outward and away from the center of the first surface 42 to define a second shoulder 66. The first shoulder 64 extends along the first surface 42 to define a second recess 65 that is sized and configured to receive a portion of the lid 30, as described in more detail herein. The second shoulder 66 extends along the lip 50 to define a notch 67 that is sized and configured to receive a portion of the second member 34.

The recess 56 extends from the second surface 44 and toward the first surface 42 and is sized and configured to receive a portion of the first rotatable member 14. The recess 56 is configured such that it defines a projection 57 that is sized and configured to be received by an aperture 104 defined by the first rotatable member 14. The notch 58 extends from the second surface 44 and toward the first surface 42 and from the first end 38 of the first member 32 toward the second end 40 of the first member 32 to provide access to the recess 56. The notch 58 has a width 59 that is sized and configured to receive a portion of the first rotatable member 14. While the first member 32 has been illustrated as defining the recess 56, the projection 57, and the notch 58, a second member of a capsule filling system can define a recess, projection, and/or notch sized and configured to receive a rotatable member and directed toward the second surface of a first member.

The second member 34 has a first end 68, a second end 70, a first surface 72, a second surface 74, and a body 76 that defines a plurality of passageways 78, a lip 80, a first projection 82, a second projection 84, a plurality of notches 86, and a plurality of apertures 88. Each passageway of the plurality of passageways 78 extends from the first surface 72 to the second surface 74 and is sized and configured to receive a portion of a capsule. The plurality of passageways 78 are arranged such that a first set 90 of the plurality of passageways 78 is disposed relative to a second set 92 of the plurality of passageways 78. Each passageway in the first set 90 is positioned a first distance from an axis that extends through the second member 34 and each passageway in the second set 92 is positioned a second distance from the axis that extends through the second member 34 that is less than the second distance. The axis that extends through the second member 34 is coaxial with the axis about which the first rotatable member 14 rotates, as described in more detail herein. The first set 90 has a first configuration that is the same as the first configuration of the first set of passageways 60 of the first member 32 and the second set 92 has a second configuration that is different than the first configuration and the same as the second configuration of the second set of passageways 62 of the first member 32.

In the illustrated embodiment, the lip 80 extends from the first surface 72 and away from the second surface 74 to define a first shoulder 94 and outward and away from the center of the first surface 72 to define a second shoulder 96. The first shoulder 94 extends along the first surface 72 to define a recess 95 that is sized and configured to receive a portion of the first member 32 such that the lip 50 of the first member 32 contacts the lip 80 of the second member 34. The second shoulder 96 extends along the lip 80 to define a notch 99 that is sized and configured to receive a portion of the third member 132, as described in more detail herein. The first projection 82 extends from the first end 68 and away from the second end 70 and defines an aperture 83 that is sized and configured to receive an attachment member 125, as described in more detail herein. Optionally, one or more protuberances can be included on a projection defined by a housing member to provide a mechanical stop to advancement of an actuator during movement between a first position and a second position. If included in an embodiment, the one or more protuberances can be sized and configured to be received by a recess defined by an actuator such that tactile feedback can be provided to user to indicate whether the actuator is in a first position or second position. Optionally, a recess can be defined on a projection that is sized and configured to house a magnet, or a portion of a magnet, to provide releasable attachment between a first housing and a second housing. Optionally any portion of a first housing can define a recess that is sized and configured to house a magnet, or a portion of a magnet, to provide releasable attachment between a first housing and a second housing.

The second projection 84 extends from the lip 80 and away from the first end 68. Each notch of the plurality of notches 86 is defined on the second projection 84, extends from a surface that is directed toward a plane that contains the second housing 18 and into the second projection 84, and is sized and configured to receive a portion of a pin 240, 242, as described in more detail herein. A first notch 87 of the plurality of notches 86 extends from a first end of the second projection 84 and toward a second end of the second projection 84 and a second notch 89 of the plurality of notches 86 extends from the second end of the second projection 84 and toward the first end of the second projection 84. Each aperture of the plurality of apertures 88 is disposed between the first notch 87 and the second notch 89 and is sized and configured to receive an attachment member 252 to releasable attach a portion of the hinge 24 to the first housing 12. While the second member 34 has been illustrated as defining a second projection 84 that has structure capable of providing attachment to a second housing 18, a first member of a capsule filling system can include structure that is similar to, or identical to, the structure defined by the second member and capable of providing attachment to a second housing. Alternatively, a second housing of a capsule filling system can include structure that is similar to, or identical to, the structure defined by the second member and capable of providing attachment to a first housing.

The first member 32 is releasably attached to the second member 34 using any structure or method of attachment considered suitable for a particular embodiment and can be based on various considerations, such as the material(s) that forms a first member and/or a second member. Example structures or methods of attachment considered suitable include using an adhesive, threaded members, attachment members, snap fit configurations, friction fit configurations, and any other structure or method considered suitable for a particular embodiment. In the illustrated embodiment, the first member 32 is adhesively attached to the second member 34.

When assembled, as shown in FIG. 9, the recess 56 defined by the first member 32 and the first surface 72 of the second member 34 cooperatively define a first housing cavity 36 that is sized and configured to receive a portion of the first rotatable member 14. In addition, each passageway of the plurality of passageways 48 defined by the first member 32 is aligned with a passageway of the plurality of passageways 78 defined by the second member 34 such that the first housing 12 defines a plurality of first housing passageways 98 that extend through the first housing 12 and provide access to the first housing cavity 36. In the illustrated embodiment, each passageway of the plurality of first housing passageways 98 has a diameter that is greater than the outside diameter of a first member of a capsule (e.g., capsule cap) intended to be filled using the capsule filling system 10.

In the illustrated embodiment, each passageway of the plurality of passageways 48 defined by the first member 32 and each passageway of the plurality of passageways 78 defined by the second member 34 is cylindrical. While each passageway of the plurality of passageways 48 defined by the first member 32 and each passageway of the plurality of passageways 78 defined by the second member 34 has been illustrated as cylindrical, any structural configuration capable of receiving a portion of a capsule and maintaining the position of the portion of the capsule is considered suitable. Example structural configurations considered suitable for a passageway defined by a housing member include passageways that are cylindrical, cuboidal, a cube, triangular prism, non-cylindrical, pentagonal prism, hexagonal prism, and any other structural configuration considered suitable for a particular embodiment.

In the illustrated embodiment, each passageway of the plurality of passageways 48 defined by the first member 32 has a first diameter and each passageway of the plurality of passageways 78 defined by the second member 34 has a second diameter that is less than the first diameter. The first diameter is oversized relative to a portion of a capsule (e.g., capsule cap, capsule body) intended to be filled by the capsule filling system 10 and is equal to 5.95 millimeters and the second diameter is equal to 5.45 millimeters.

While each passageway of the plurality of passageways 48 defined by the first member 32 has been illustrated as having a first diameter equal to 5.95 millimeters and each passageway of the plurality of passageways 78 defined by the second member 34 has been illustrated as having a second diameter equal to 5.45 millimeters, a member can define one or more passageways having any suitable diameter. Selection of a suitable diameter to define one or more passageways on a member can be based on various considerations, including the structural arrangement of a capsule intended to be filled by a capsule filling system. Example diameters considered suitable for a passageway defined by a member include diameters equal to, substantially equal to, near, or about, 5.95 millimeters, 5.45 millimeters, diameters greater than 5.45 millimeters, diameters greater than 5.95 millimeters, diameters less than 5.45 millimeters, diameters less than 5.95 millimeters, and any other diameter considered suitable for a particular embodiment. Alternative embodiments can include a first member that defines a plurality of passageways, or one or more passageways, that each have a diameter that is equal to, substantially equal to, or less than the diameter of a passageway defined by a second member.

In the illustrated embodiment, the first rotatable member 14 is partially disposed within the first housing 12 and has a first surface 100, a second surface 101, and a body 102 that defines a plurality of passageways 103, an aperture 104, and a projection 105. Each passageway of the plurality of passageways 103 extends from the first surface 100 to the second surface 101 and is sized and configured to receive a portion of a capsule. The plurality of passageways 103 are arranged such that a first set 106 of the plurality of passageways 103 is disposed relative to a second set 107 of the plurality of passageways 103. The first set 106 is positioned a first distance from an axis that extends through the first rotatable member 14 and the second set 107 is positioned a second distance from the axis that extends through the first rotatable member 14 that is less than the first distance. The first rotatable member 14 rotates about the axis that extends through the first rotatable member 14 is coaxial with the axis that extends through the first member 32 and the axis that extends through the second member 34. In the illustrated embodiment, the first distance is the same as the first distance of the first member 32, the first distance of the second member 34, the second distance is the same as the second distance of the first member 32, and the second distance is the same as the second distance of the second member 34. Thus, the first set 106 has a first configuration that is the same as the first configuration of the first set of passageways 60 of the first member 32 and the second set 107 has a second configuration that is different than the first configuration and the same as the second configuration of the second set of passageways 62 of the first member 32.

The aperture 104 extends from the first surface 100 to the second surface 101 and is sized and configured to receive a portion of the projection 57 defined by the first member 32. Alternative embodiments can include a first housing that defines a recess that is sized and configured to receive a projection defined by a first rotatable member. The projection 105 extends from the body 103 of the first rotatable member 14 and has a width 109 that is sized and configured to be positioned within the notch 58 defined by the first member 32. In the illustrated embodiment, the width 59 of the notch 58 is greater than the width 109 of the projection 105 such that the projection 105 can be moved within the notch 58. Movement of the projection 105 within the notch 58 moves the first rotatable member 14 between its first and second positions, as described herein.

While the first member 32 has been illustrated as defining a plurality of passageways 48, the second member 34 has been illustrated as defining a plurality of passageways 78, and the first rotatable member 14 has been illustrated as defining a plurality of passageways 103, a first member, second member, and first rotatable member can define any suitable number of passageways. The number of passageways defined by a housing member and/or first rotatable member can be based on various considerations, including the configuration of a capsule intended to be filled. Example number of passageways considered suitable for a first member, second member, and/or first rotatable member to define include one, at least one, two, a plurality, three, four, five, more than five, more than ten, twenty-five, fifty, one hundred, more than twenty-five, more than fifty, more than one hundred, and any other number considered suitable for a particular embodiment.

The first actuator 16 has a first surface 112, a second surface 114, and a body 116 that defines a base 118, an arm 120, an aperture 122, a recess 124. The arm 120 extends from the base 118 and away from the aperture 122. The aperture 122 is disposed on the base 118 and is sized and configured to receive a portion of an attachment member 125 such that the first actuator 16 is rotatably attached to the second member 34. The recess 124 is disposed on the base 118 and extends from the second surface 114 toward the first surface 112 and from an outer edge of the base 118 toward the aperture 122. The recess 120 is sized and configured to receive a portion of the projection 105 defined by the first rotatable member 14.

In the illustrated embodiment, the recess 124 has a first end 126 and a second end 128. The first end 126 is positioned a first distance from a plane that contains an axis that extends through the aperture 122 and the second end 128 is positioned a second distance from the plane that contains the axis that extends through the aperture 122. The first distance is different than the second distance such that movement of the first actuator 16 between first and second positions moves the first rotatable member 14 between its first and second positions. In the illustrated embodiment, the first distance is greater than the second distance. While the first distance has been illustrated as being different than the second distance, a first end and a second end of a recess can be positioned any suitable distance from a plane that contains an axis that extends through an aperture defined by an actuator and can be based on various considerations, such as the structural arrangement of a rotatable member and/or the amount of movement desired by a rotatable member during use. For example, a first end and a second end of a recess defined by an actuator can be positioned the same distance from a plane that contains an axis that extends through an aperture defined by the actuator.

The attachment member 125 is disposed through the aperture 83 defined by the second member 34 and the aperture 122 defined by the first actuator 16 and attached to the second member 34 and the first actuator 16. The attachment member 125 can be attached to the second member 34 and the first actuator 16 using any suitable structure or method of attachment capable of providing rotatable attachment of the first actuator 16 to the second member 34. Example structures or methods of attachment considered suitable between an attachment member, a housing member, and an actuator include snap fit configurations, fixedly attaching a first end of an attachment member to a housing member and rotatably attaching a second end of the attachment member to an actuator, fixedly attaching a first end of an attachment member to an actuator and rotatably attaching a second end of the attachment member to a housing member, and any other structure or method considered suitable for a particular embodiment.

Figure 5:
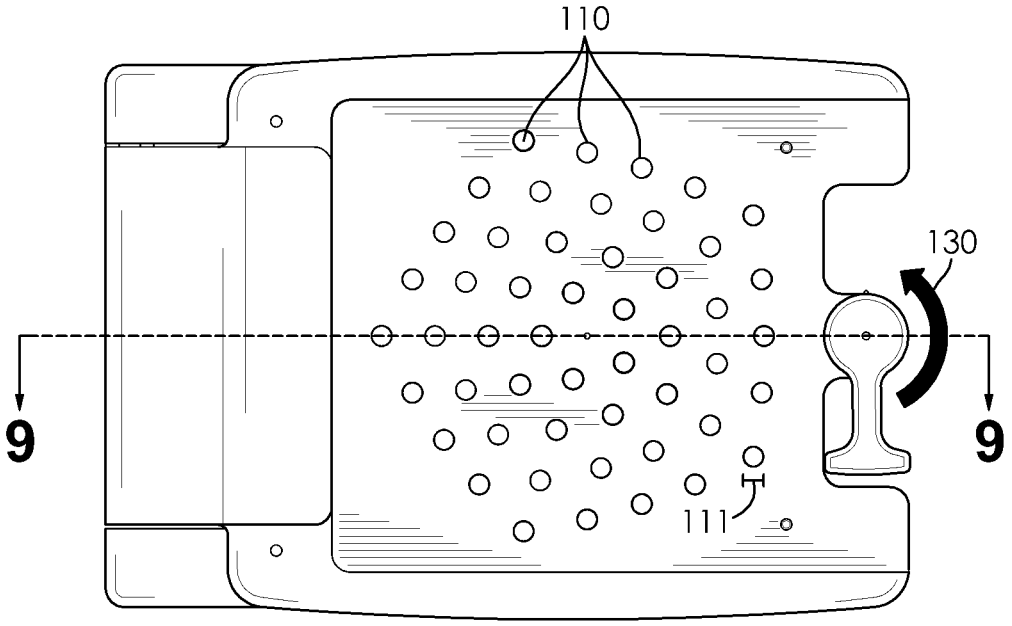
FIG. 5 is a top view of the capsule filling system illustrated in FIG. 1. Each of the first actuator and the second actuator are in a first position. The lid has been omitted for clarity.
Figure 6:
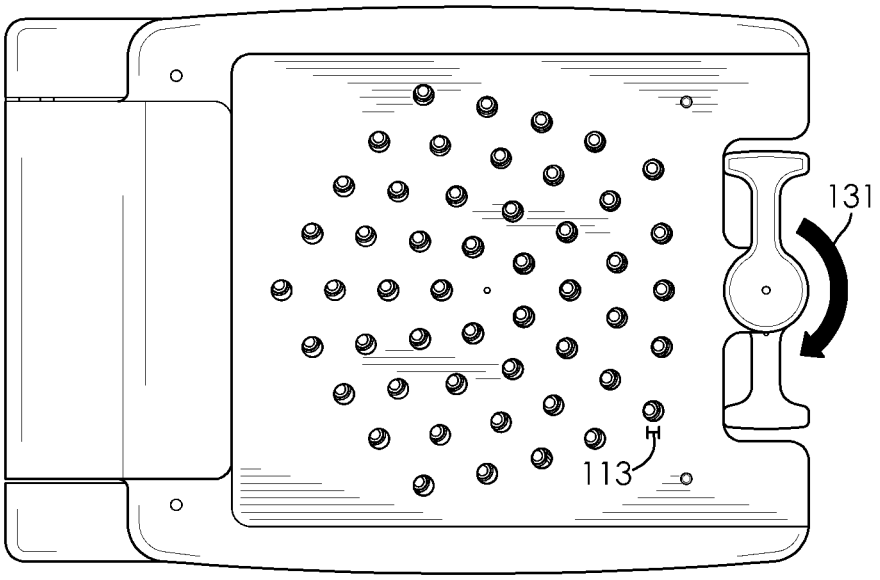
FIG. 6 is a top view of the capsule filling system illustrated in FIG. 5. The first actuator is in a second position and the second actuator is in a first position.

When assembled, as shown in FIG. 1, the first rotatable member 14 is partially disposed within the first housing cavity 36 and is rotatably attached to the first housing 12. This is accomplished by placing the projection 57 defined by the first member 32 within the aperture 104 defined by the first rotatable member 14 and attaching the first member 32 to the second member 34. The first rotatable member 14 is moveable between a first position and a second position by moving the first actuator 16 between first and second positions. The first rotatable member 14 rotates about an axis that extends through the first rotatable member 14 (e.g., aperture 104). In the first position, as shown in FIG. 5, each passageway of the plurality of passageways 103 defined by the first rotatable member 14 is aligned with a passageway of the plurality of first housing passageways 98 to cooperatively define a plurality of first member passageways 110. Alternatively, one or more passageways of a plurality of passageways defined by the first rotatable member can be aligned with a passageway of a plurality of first housing passageways to cooperatively define one or more first member passageways. Each passageway of the plurality of first member passageways 110 has a first diameter 111 when the first rotatable member 14 is in the first position, as shown in FIG. 5. Each passageway of the plurality of first member passageways 110 has a second diameter 113 when the first rotatable member 14 is in the second position, as shown in FIG. 6. In the illustrated embodiment, the second diameter 113 is less than the first diameter 111 by 0.45 millimeters. The first diameter 111 of each passageway of the plurality first member passageways 110 is greater than the outside diameter of a first member of a capsule (e.g., capsule cap) intended to be filled by the capsule filling system 10. Alternatively, in embodiments in which the first housing is configured to provide releasable attachment between the housing and a second member of a capsule (e.g., capsule body), the first housing and the first rotatable member can cooperatively define a plurality of first member passageways such that each passageway of the plurality of first member passageways has a first diameter that is greater than the outside diameter of a second member of a capsule (e.g., capsule body) intended to be filled by a capsule filling system.

As shown in FIG. 5, the first rotatable member 14 is moved from the first position to the second position by applying a force on the arm 120 of the first actuator 16 in the direction of arrow 130 such that the first actuator 16 pivots on an axis that extends through the aperture 122 defined by the first actuator 16 and advances toward a first side of the first housing 12. As shown in FIG. 6, the first rotatable member 14 is moved from the second position to the first position by applying a force on the arm 120 of the first actuator 16 in the direction of arrow 131 such that the first actuator 16 pivots on an axis that extends through the aperture 122 defined by the first actuator 16 and advances toward a second side of the first housing 12.

While the second diameter 113 has been illustrated as being less than the first diameter 111 by 0.45 millimeters, the second diameter of a plurality of first member passageways can have any suitable diameter relative to a first diameter. Selection of a suitable diameter for a second diameter of a plurality of first member passageways can be based on various considerations, such as the desired amount of force intended to be applied to each capsule. Examples of a suitable diameters for a second diameter of a plurality of first member passageways include diameters that are equal to the first diameter less a length equal to, substantially equal to, greater than, less than, about, or near 0.45 millimeters, and any other length considered suitable for a particular embodiment.

In the illustrated embodiment, the second housing 18 has a third member 132 and a fourth member 134 that cooperatively define a second housing cavity 136, as shown in FIG. 9. The third member 132 has a first end 138, a second end 140, a first surface 142, a second surface 144, and a body 146 that defines a plurality of passageways 148, a lip 150, a first projection 152, a second projection 154, a third projection 156, a plurality of apertures 158, a first recess 160, and a second recess 162. Each passageway of the plurality of passageways 148 extends from the first surface 142 to the second surface 144 and is sized and configured to receive a portion of a capsule. The plurality of passageways 148 are arranged such that a first set 164 of the plurality of passageways 148 is disposed relative to a second set 166 of the plurality of passageways 148. The first set 164 is positioned a first distance from an axis that extends through the third member 132 and the second set 166 is positioned a second distance from the axis that extends through the third member 132 that is less than the first distance. The axis that extends through the third member 134 is coaxial with an axis about which the second rotatable member 20 rotates, as described in more detail herein. The first set 164 has a first configuration and the second set 166 has a second configuration that is different than the first configuration.

In the illustrated embodiment, the lip 150 extends from the first surface 142 and away from the second surface 144 to define a first shoulder 168. The first shoulder 168 extends along the first surface 142 to define a third recess 169 that is sized and configured to receive a portion of the second member 34 of the first housing 12. The first projection 152 extends from the first end 138 and away from the second end 140 and defines an aperture 153 that is sized and configured to receive an attachment member 225, as described in more detail herein. Optionally, one or more protuberances can be included on a projection defined by a housing member to provide a mechanical stop to advancement of an actuator in during movement between a first position and a second position. If included in an embodiment, the one or more protuberances can be sized and configured to be received by a recess defined by an actuator such that tactile feedback can be provided to a user to indicate whether the actuator is in a first position or second position. Optionally, a recess can be defined on a projection that is sized and configured to house a magnet, or a portion of a magnet, to provide releasable attachment between a first housing and a second housing. Optionally any portion of a second housing can define a recess that is sized and configured to house a magnet, or a portion of a magnet, to provide releasable attachment between a first housing and a second housing.

Each of the second projection 154 and the third projection 156 extends from the second end 140 and away from the first end 138. The second projection 154 is separated from the third projection 156 such that a portion of hinge 24 can be positioned between the second projection 154 and the third projection 156. A first aperture of the plurality of apertures 158 is defined on the second projection 154 and a second aperture of the plurality of apertures 158 is defined on the third projection 156. Each of the first aperture of the plurality of apertures 158 and the second aperture of the plurality of apertures 158 is disposed on an axis that extends through the second projection 154 and the third projection 156. The first aperture of the plurality of apertures 158 is sized and configured to receive a portion of a first pin 240, as described in more detail herein. The second aperture of the plurality of apertures 158 is sized and configured to receive a portion of a second pin 242, as described in more detail herein. The body 146 of the third member 132 defines threads that extend into each aperture of the plurality of apertures 158 that are sized and configured to mate with the threads defined by the first pin 240 and/or second pin 242. While the third member 132 has been illustrated as defining a second projection 154 and a third projection 156 that have structure capable of providing attachment to a first housing 12, a fourth member of a capsule filling system can include structure that is similar to, or identical to, the structure defined by the third member and capable of providing attachment to a first housing. Alternatively, a first housing of a capsule filling system can include structure that is similar to, or identical to, the structure defined by the third member and capable of providing attachment to a second housing.

Each of the first recess 160 and second recess 162 extends from the second surface 144 and toward the first surface 142 and is sized and configured to receive a portion of the base 26, as described in more detail herein. The first recess 160 is positioned on a first side of the plurality of passageways 148 and the second recess 162 is positioned on a second side of the plurality of passageways 148 that is different than the first side.

In the illustrated embodiment, the fourth member 134 has a first end 170, a second end 172, a first surface 174, a second surface 176, and a body 178 that defines a recess 180, a plurality of passageways 182, a notch 184, a lip 186, a plurality of recesses 188, a plurality of apertures 189, a first elongated passageway 190, and a second elongated passageway 192.

The recess 180 extends from the first surface 174 and toward the second surface 176 and is sized and configured to receive a portion of the second rotatable member 20. The recess 180 is configured such that it defines a projection 181 that is sized and configured to be received by an aperture 204 defined by the second rotatable member 20. Each passageway of the plurality of passageways 182 extends from the base of the recess 180 to the second surface 176 and is sized and configured to receive a portion of a capsule. The plurality of passageways 182 are arranged such that a first set 194 of the plurality of passageways 182 is disposed relative to a second set 196 of the plurality of passageways 182. The first set 194 is positioned a first distance from an axis that extends through the fourth member 134 and the second set 196 is positioned a second distance from the axis that extends through the fourth member 134 that is less than the first distance. The axis that extends through the fourth member is coaxial with the axis about which the second rotatable member 20 rotates, as described in more detail herein. The first set 194 has a first configuration and the second set 196 has a second configured that is different than the first set 194. The first set 194 has a configuration that is the same as the first configuration of the first set of passageways 164 of the third member 132 and the first set of passageways 90 of the second member 34. The second set 196 has a configuration that is the same as the second configuration of the second set 166 of the third member 132 and the second set of passageways 92 of the second member 34.

The notch 184 extends from the first surface 174 and toward the second surface 176 and from the first end 170 of the fourth member 134 toward the second end 172 of the fourth member 134 to provide access to the recess 180. The notch 184 has a width 185 that is sized and configured to receive a portion of the second rotatable member 20. While the fourth member 134 has been illustrated as defining the recess 180, the projection 181, and the notch 184, a third member of a capsule filling system can define a recess, a projection, and/or a notch sized and configured to receive a rotatable member and directed toward the first surface of a fourth member.

In the illustrated embodiment, the lip 186 extends from the second surface 176 and away from the first surface 174 to define a first shoulder 198. The first shoulder 198 extends along the second surface 176 to define a cavity 199 that is sized and configured to receive a portion of the base 26, as described in more detail herein. Each recess of the plurality of recesses 188 extends from the second surface 176 toward the first surface 174 and is sized and configured to receive a portion of a spring of the plurality of springs 28, as described in more detail herein. An aperture of the plurality of apertures 189 is positioned within each recess of the plurality of recesses 188. Each aperture of the plurality of apertures 189 defines threads and is sized and configured to receive a portion of an attachment member 294, as described in more detail herein.

Each of the first elongate passageway 190 and second elongate passageway 192 extends from the first surface 174 to the second surface 176 and is sized and configured to receive a portion of the base 26. The first elongate passageway 190 is positioned on a first side of the plurality of passageways 182 and the second elongate passageway 192 is positioned on a second side of the plurality of passageways 182 that is different than the first side.

The third member 132 is releasably attached to the fourth member 134 using any structure or method of attachment considered suitable for a particular embodiment and can be based on various considerations, such as the material(s) that forms a third member and/or a fourth member. Example structures or methods of attachment considered suitable include using an adhesive, threaded members, attachment members, snap fit configurations, friction fit configurations, and any other structure or method considered suitable for a particular embodiment. In the illustrated embodiment, the third member 132 is adhesively attached to the fourth member 134.

When assembled, as shown in FIG. 9, the recess 180 defined by the fourth member 134 and the second surface 144 of the third member 132 cooperatively define a second housing cavity 136 that is sized and configured to receive a portion of the second rotatable member 20. In addition, as shown in FIG. 9, each passageway of the plurality of passageways 148 defined by the third member 132 is aligned with a passageway of the plurality of passageways 182 defined by the fourth member 134 such that the second housing 18 defines a plurality of second housing passageways 193 that extend through the second housing 14 and provide access to the second housing cavity 136. In the illustrated embodiment, each passageway of the plurality of second housing passageways 193 has a diameter that is greater than the outside diameter of a second member of a capsule (e.g., capsule body) intended to be filled using the capsule filling system 10.

In the illustrated embodiment, each passageway of the plurality of passageways 148 defined by the third member 132 and each passageway of the plurality of passageways 182 defined by the fourth member 134 is cylindrical. While each passageway of the plurality of passageways 148 defined by the third member 132 and each passageway of the plurality of passageways 182 defined by the fourth member 134 has been illustrated as cylindrical, any structural configuration capable of receiving a capsule and maintaining the position of the capsule is considered suitable. Example structural configurations considered suitable for a passageway defined by a housing member include passageways that are cylindrical, cuboidal, a cube, triangular prism, non-cylindrical, pentagonal prism, hexagonal prism, and any other structural configuration considered suitable for a particular embodiment.

In the illustrated embodiment, each passageway of the plurality of passageways 148 defined by the third member 132 has a first diameter and each passageway of the plurality of passageways 182 defined by the fourth member 134 has a second diameter that is greater than the first diameter. The second diameter is oversized relative to a portion of a capsule (e.g., capsule cap, capsule body) intended to be filled by the capsule filling system 10 and is equal to 5.30 millimeters and the first diameter is equal to 5.10 millimeters.

While each passageway of the plurality of passageways 148 defined by the third member 132 has been illustrated as having a first diameter equal to 5.10 millimeters and each passageway of the plurality of passageways 182 defined by the fourth member 134 has been illustrated as having a second diameter equal to 5.30 millimeters, a member can define one or more passageways having any suitable diameter. Selection of a suitable diameter to define one or more passageways on a member can be based on various considerations, including the structural arrangement of a capsule intended to be filled by a capsule filling system. Example diameters considered suitable for a passageway defined by a member include diameters equal to, substantially equal to, near, or about, 5.30 millimeters, 5.10 millimeters, diameters greater than 5.10 millimeters, diameters greater than 5.30 millimeters, diameters less than 5.10 millimeters, diameters less than 5.30 millimeters, and any other diameter considered suitable for a particular embodiment. Alternative embodiments can include a third member that defines a plurality of passageways, or one or more passageways, that each have a diameter that is equal to, substantially equal to, or greater than the diameter of a passageway defined by a fourth member.

The first housing 12 and second housing 18 can be formed of any suitable material and using any suitable manufacturing technique. Selection of a suitable material to form a first housing and/or second housing and/or selection of a suitable manufacturing technique can be based on various considerations, including the material(s) that forms a first rotatable member and/or second rotatable member. Example materials considered suitable to form a first housing and/or second housing include metals such as stainless steel, titanium, polymers, polyethylene, polyvinyl chloride, polystyrene, and any other material considered suitable for a particular embodiment. Example techniques considered suitable to form a first housing and/or second housing include injection molding, casting, and any other technique considered suitable for a particular embodiment. In the illustrated embodiment, the first housing 12 and the second housing 18 are formed of a polymer. Alternative to forming a first housing or a second housing of a single material, a first member can be formed of a first material that is different than a second material that forms a second member and/or a third member can be formed of a third material that is different than a fourth material that forms a fourth member.

While the first housing 12 and second housing 18 have been illustrated as having a particular structural configuration, a first housing and second housing of a capsule filling system can have any suitable size, shape, and configuration, and the illustrated first housing and second housing are merely examples of a suitable housing configurations. For example, the first housing and second housing can be formed as a single component. Alternatively, or in combination with forming the first housing and the second housing as a single component, a first housing and/or second housing, and/or the components that form a first housing and/or second housing, can define any suitable number of passageways, notches, recesses, or any other feature considered suitable to form a capsule filling system capable of performing the functions described herein. For example, a first housing can define a plurality of passageways that are sized and configured to receive a first member of a capsule and a second housing can define a plurality of passageways that are sized and configured to receive a second member of a capsule. While particular members have been illustrated as defining a recess, notch, and projection that are sized and configured of receiving a rotatable member, any member can define a recess, notch, and/or projection that are sized and configured to receive a rotatable member.

Optionally, a first housing or a second housing can include a magnet. If included on the first housing, the magnet can be attached to the first housing (e.g., on first projection of second member) such that a first magnetic pole is directed toward the second housing that results in attraction between the magnet and the second housing. If included on the second housing, the magnet can be attached to the second housing (e.g., on first projection of third member) such that a first magnet pole is directed toward the first housing that results in attraction between the magnet and the first housing. Alternatively, a first housing can include a first magnet and a second housing can include a second magnet. For example, the first magnet can be attached to the first housing and the second magnet can be attached to the second housing. The first magnet has a first magnetic pole that is directed toward the second magnet and the second magnet has a second magnetic pole that is directed toward the first magnet. The first magnetic pole is different than the second magnetic pole such that when the first magnet and second magnet are brought together, or near one another, the force required to move the first housing away from the second housing increases. The inclusion of a magnet, or more than one magnet, provides a mechanism to maintain the capsule filling system in the closed configuration.

In the illustrated embodiment, the second rotatable member 20 is partially disposed within the second housing 18 and has a first surface 200, a second surface 201, and a body 202 that defines a plurality of passageways 203, an aperture 204, and a projection 205. Each passageway of the plurality of passageways 203 extends from the first surface 200 to the second surface 201 and is sized and configured to receive a portion of a capsule. The plurality of passageways 203 are arranged such that a first set 206 of the plurality of passageways 203 is disposed relative to a second set 207 of the plurality of passageways 203. The first set 206 is positioned a first distance from an axis that extends through the second rotatable member 20 and the second set 207 is positioned a second distance from the axis that extends through the second rotatable member 20 that is less than the first distance. The second rotatable member 20 rotates about the axis that extends through the second rotatable member 20 and is coaxial with the axis that extends through the first member 32, the axis that extends through the second member 34, the axis that extends through the third member 132, and the axis that extends through the fourth member 134. In the illustrated embodiment, the first distance is the same as the first distance of the first member 32, the first distance of the third member 132 and the second distance is the same as the second distance of the first member 32 and the second distance of the third member 132. The first set 206 has a first configuration that is the same as the first configuration of the first set of passageways 60 of the first member 32 and the first configuration of the first set of passageways 164 of the third member 132. The second set 207 has a second configuration that is different than the first configuration and the same as the second configuration of the second set of passageways 62 of the first member 32 and the second configuration of the second set of passageways 166 of the third member 132.

The aperture 204 extends from the first surface 200 to the second surface 201 and is sized and configured to receive a portion of the projection 181 defined by the fourth member 134. Alternative embodiments can include a fourth housing that defines a recess that is sized and configured to receive a projection defined by a second rotatable member. The projection 205 extends from the body 202 of the second rotatable member 20 and has a width 209 that is sized and configured to be positioned within the notch 184 defined by the fourth member 134. In the illustrated embodiment, the width 185 of the notch 184 is greater than the width 209 of the projection 205 such that the projection 205 can be moved within the notch 184. Movement of the projection 205 within the notch 184 moves the second rotatable member 20 between its first and second positions, as described herein.

In the illustrated embodiment, each passageway of the plurality of passageways 103 defined by the first rotatable member 14 and each passageway of the plurality of passageways 203 defined by the second rotatable member 20 is oblong. Each passageway in the first set of passageways 103 defined by the first rotatable member 14 and each passageway in the first set of passageways 206 defined by the second rotatable member 20 has a first length 215. Each passageway in the second set of passageways 107 defined by the first rotatable member 14 and each passageway of the second set of passageways 207 defined by the second rotatable member 20 has a second length 217. The first length 215 is greater than the second length 217 such that the passageways positioned closer to the axis that extends through the first rotatable member 14 or the second rotatable member 20 have a length that is smaller than the passageways that are farther from the axis that extends through the first rotatable member 14 or the second rotatable member 20.

While each passageway of the plurality of passageways 103 defined by the first rotatable member 14 and each passageway of the plurality of passageways 203 defined by the second rotatable member 20 has been illustrated as oblong, any structural configuration capable of receiving a portion of a capsule and maintaining the position of the portion of the capsule is considered suitable. Example structural configurations considered suitable for a passageway defined by a rotatable member include passageways that are cylindrical, cuboidal, a cube, triangular prism, non-cylindrical, pentagonal prism, hexagonal prism, and any other structural configuration considered suitable for a particular embodiment. Alternative embodiments can include one or more projections and/or notches on one or more passageways defined by a first rotatable member and/or second rotatable member. Each projection extends from a surface defining a passageway and into the passageway and can be any suitable size or shape capable of assisting with releasably attaching a portion of a capsule to a member of a capsule filling system. Each notch extends from a surface defining a passageway and into the body of the rotatable member and can be any suitable size or shape capable of assisting with releasably attaching a portion of a capsule to a member of a capsule filling system.

In the illustrated embodiment, each passageway of the plurality of passageways 103 defined by the first rotatable member 14 has a first diameter 119 and each passageway of the plurality of passageways 203 defined by the second rotatable member 20 has a second diameter 221 that is less than the first diameter 119. The first diameter 119 and the second diameter 221 are each less than the first length 215. The first diameter 119 is equal to 5.45 millimeters and the second diameter 221 is equal to 5.10 millimeters.

While each passageway of the plurality of passageways 103 defined by the first rotatable member 14 has been illustrated as having a first diameter 119 equal to 5.45 millimeters and each passageway of the plurality of passageways 203 defined by the second rotatable member 20 has been illustrated as having a second diameter 221 equal to 5.10 millimeters, a rotatable member can define one or more passageways having any suitable diameter. Selection of a suitable diameter to define one or more passageways on a rotatable member can be based on various considerations, including the structural arrangement of a capsule intended to be filled by a capsule filling system. Example diameters considered suitable for a passageway defined by a rotatable member include diameters equal to, substantially equal to, near, or about, 5.45 millimeters, 5.10 millimeters, diameters greater than 5.10 millimeters, diameters greater than 5.45 millimeters, diameters less than 5.10 millimeters, diameters less than 5.45 millimeters, and any other diameter considered suitable for a particular embodiment. Alternative embodiments can include a first rotatable member that defines a plurality of passageways, or one or more passageways, that each have a diameter that is equal to, substantially equal to, or less than the diameter of a passageway defined by a second rotatable member.

The first rotatable member 14 and second rotatable member 20 can be formed of any suitable material and using any suitable manufacturing technique. Selection of a suitable material to form a first rotatable member and/or second rotatable member and/or selection of a suitable manufacturing technique can be based on various considerations, including the material(s) that forms a first housing, second housing, and/or a member of the first housing or second housing. Example materials considered suitable to form a first rotatable member and/or second rotatable member include metals such as stainless steel, titanium, polymers, polyethylene, polyvinyl chloride, polystyrene, and any other material considered suitable for a particular embodiment. Example techniques considered suitable to form a first rotatable member and/or second rotatable member include injection molding, casting, and any other technique considered suitable for a particular embodiment. In the illustrated embodiment, the first rotatable member 14 and the second rotatable member 20 are formed of stainless steel. However, alternative embodiments can include a first rotatable member and/or second rotatable member that are/is formed of the same, or a different, material than the material that forms the first housing and/or the second housing.

While the first rotatable member 14 and the second rotatable member 20 have been illustrated as having a particular structural configuration, a first rotatable member and second rotatable member of a capsule filling system can have any suitable size, shape, and configuration, and the illustrated first rotatable member and second rotatable member are merely examples of a suitable rotatable member configuration. For example, while the first rotatable member 14 and second rotatable member 20 have been illustrated as having a cylindrical body, a rotatable member can have a body that defines any suitable configuration, such as a cuboid, triangular prism, cylinder, and any other configuration considered suitable for a particular embodiment.

While the first rotatable member 14 has been illustrated as being partially disposed within the first housing 12 and the second rotatable member 20 has been illustrated as being partially disposed within the second housing 18, a first rotatable member can be entirely disposed within a first housing and/or a second rotatable member can be entirety disposed within a second housing. The configuration of the first rotatable member and/or the second rotatable member will be based on various considerations, including the structural arrangement of the housings and the actuators.

While the third member 132 has been illustrated as defining a plurality of passageways 148, the fourth member 134 has been illustrated as defining a plurality of passageways 182, and the second rotatable member 20 has been illustrated as defining a plurality of passageways 206, a third member, fourth member, and second rotatable member can define any suitable number of passageways. The number of passageways defined by a housing member and/or second rotatable member can be based on various considerations, including the configuration of a capsule intended to be filled. Example number of passageways considered suitable for a third member, fourth member, and/or second rotatable member to define include one, at least one, two, a plurality, three, four, five, more than five, more than ten, twenty-five, fifty, one hundred, more than twenty-five, more than fifty, more than one hundred, and any other number considered suitable for a particular embodiment.

The second actuator 22 has a first surface 212, a second surface 214, and a body 216 that defines a base 218, an arm 220, an aperture 222, and a recess 224. The arm 220 extends from the base 218 and away from the aperture 222. The aperture 222 is disposed on the base 218 and is sized and configured to receive a portion of an attachment member 225 such that the second actuator 22 is rotatably attached to the third member 132. The recess 224 is disposed on the base 218 and extends from the first surface 212 toward the second surface 214 and from an outer edge of the base 218 toward the aperture 222. The recess 220 is sized and configured to receive a portion of the projection 205 defined by the second rotatable member 20.

In the illustrated embodiment, the recess 224 has a first end 226 and a second end 228. The first end 226 is positioned a first distance from a plane that contains an axis that extends through the aperture 222 and the second end 228 is positioned a second distance from the plane that contains the axis that extends through the aperture 222. The first distance is different than the second distance such that movement of the second actuator 22 between first and second positions moves the second rotatable member 22 between its first and second positions. In the illustrated embodiment, the first distance is greater than the second distance. While the first distance has been illustrated as being different than the second distance, a first end and a second end of a recess can be positioned any suitable distance from a plane that contains an axis that extends through an aperture defined by an actuator and can be based on various considerations, such as the structural arrangement of a rotatable member and/or the amount of movement desired by a rotatable member during use. For example, a first end and a second end of a recess defined by an actuator can be positioned the same distance from a plane that contains an axis that extends through an aperture defined by the actuator.

Figure 7:
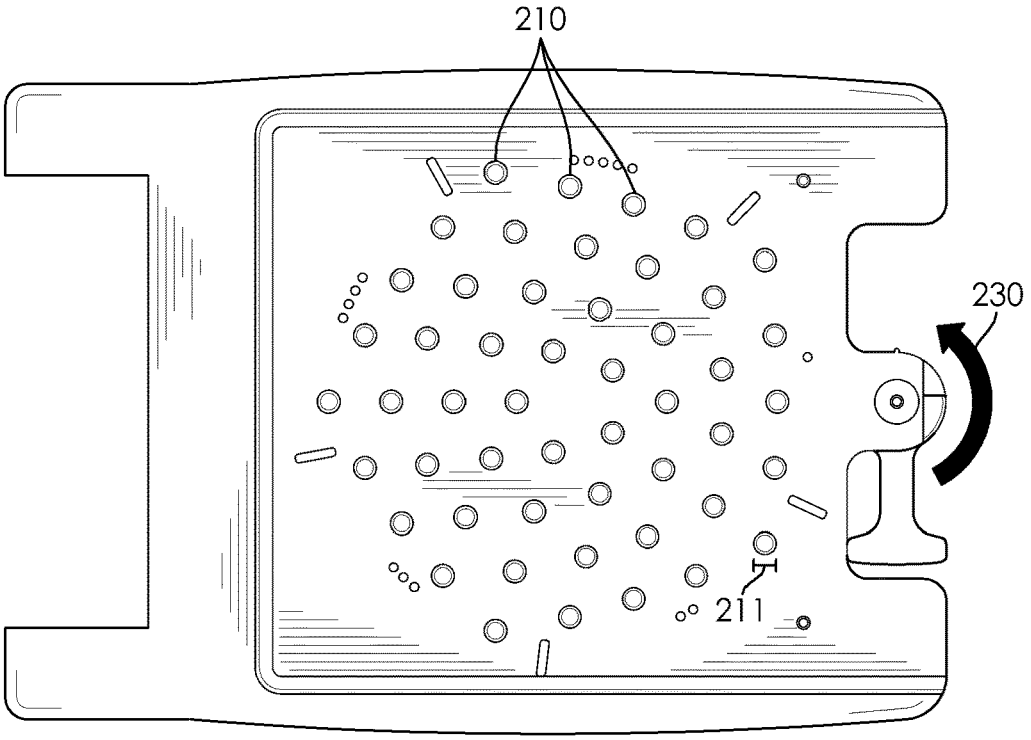
FIG. 7 is a top view of the second housing, the second rotatable member, and the second actuator of the capsule filling system illustrated in FIG. 1. The second actuator is in a first position.
Figure 8:
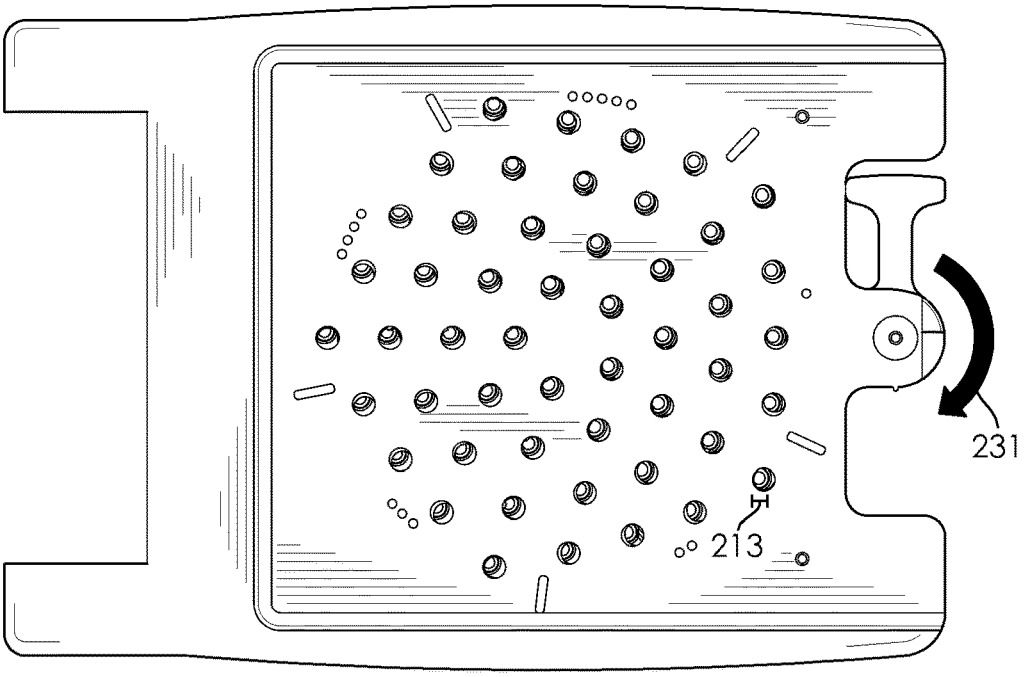
FIG. 8 is a top view of the capsule filling system illustrated in FIG. 7. The second actuator is in a second position.

When assembled, as shown in FIG. 9, the second rotatable member 22 is partially disposed within the second housing cavity 136 and rotatably attached to the second housing 18. This is accomplished by placing the projection 181 defined by the fourth member 134 within the aperture 204 defined by the second rotatable member 20 and attaching the third member 132 to the fourth member 134. The second rotatable member 20 is moveable between a first position and a second position by moving the second actuator 22 between first and second positions. The second rotatable member 20 rotates about an axis that extends through the second rotatable member 20 (e.g., aperture 204). In the first position, as shown in FIG. 7, each passageway of the plurality of passageways 206 defined by the second rotatable member 20 is aligned with a passageway of the plurality of second housing passageways 193 to cooperatively define a plurality of second member passageways 210. Alternatively, one or more passageways of a plurality of passageways defined by the second rotatable member can be aligned with a passageway of a plurality of second housing passageways to cooperatively define one or more second member passageways. Each passageway of the plurality of second member passageways 210 has a first diameter 211 when the second rotatable member 22 is in the first position, as shown in FIG. 7. Each passageway of the plurality of second member passageways 210 has a second diameter 213 when the second rotatable member 22 is in the second position, as shown in FIG. 8. In the illustrated embodiment, the second diameter 213 is less than the first diameter 211 by 0.2 millimeters. In the illustrated embodiment, each passageway of the plurality of second member passageways 210 has a diameter that is less than the outside diameter of a first member of a capsule (e.g., capsule cap) intended to be filled by the capsule filling system 10. The first diameter 211 of each passageway of the plurality of capsule passageways 210 is greater than the outside diameter of a second member of a capsule (e.g., capsule body) intended to be filled by the capsule filling system 10. Alternatively, in embodiments in which the second housing is configured to provide releasable attachment between a first member of a capsule (e.g., capsule cap), the second housing and the second rotatable member can cooperatively define a plurality of second member passageways such that each passageway of the plurality of second member passageways has a first diameter that is greater than the outside diameter of a first member of a capsule (e.g., capsule cap) intended to be filled by a capsule filling system.

As shown in FIG. 7, the second rotatable member 20 is moved from the first position to the second position by applying a force to the arm 220 of the second actuator 22 in the direction of arrow 230 such that the second actuator 22 pivots on an axis that extends through the aperture 222 defined by the second actuator 22 and advances toward a first side of the second housing 18. As shown in FIG. 8, the second rotatable member 20 is moved from the second position to the first position by applying a force to the arm 220 of the second actuator 22 in the direction of arrow 231 such that the second actuator 22 pivots on an axis that extends through the aperture 222 defined by the second actuator 22 and advances toward a second side of the second housing 18.

In the illustrated embodiment, the first rotatable member 18 and the second rotatable member 20 each move 5 degrees from the first position to the second position, and vise versa, to accomplish releasable attachment between a portion of a capsule the first member or second member. While the first rotatable member 18 and the second rotatable member 20 have been illustrated as moving 5 degrees between their first position and second position, any suitable amount of movement can be accomplished. For example, a first rotatable member and a second rotatable member can each move an amount equal to, substantially equal to, greater than, less than, about, or near, 5 degrees, or any other amount considered suitable for a particular embodiment.

While the second diameter 213 has been illustrated as being less than the first diameter 211 by 0.2 millimeters, the second diameter of a plurality of second member passageways can have any suitable diameter relative to a first diameter. Selection of a suitable diameter for a second diameter of a plurality of second member passageways can be based on various considerations, such as the desired amount of force intended to be applied to each capsule. Examples of a suitable diameters for a second diameter of a plurality of second member passageways include diameters that are equal to the first diameter less a length equal to, substantially equal to, greater than, less than, about, or near 0.2 millimeters, and any other length considered suitable for a particular embodiment.

While the first actuator 16 has been illustrated as an actuator that rotates relative to a portion of the first housing 12 and the second actuator 22 has been illustrated as an actuator that rotates relative to a portion of the second housing 18, any suitable actuator can be included in a capsule filling system that is capable of moving a rotatable member between its first and second positions, or a position between the first and second positions. Selection of an actuator to include in a capsule filling system can be based on various considerations, including the structural arrangement of a first housing and/or second housing. Example actuators considered suitable to include in a capsule filling system include linear actuators, rotatable actuators, pivotable actuators, electro-mechanical actuators, and any other actuator considered suitable for a particular embodiment.

While a first actuator 16 and a second actuator 22 have been illustrated as included on the capsule filling system 10, a capsule filling system can omit the inclusion of a first actuator and/or second actuator. In these alternative embodiments, movement of a first rotatable member can be accomplished by applying a force directly on the first rotatable member or on the projection defined by the first rotatable member and/or movement of a second rotatable member can be accomplished by applying a force directly on the second rotatable member or on the projection defined by the second rotatable member.

Alternative embodiments can include a first actuator that defines a projection that extends from the second surface on the arm and away from the first surface and a second actuator that defines a projection that extends from the first surface on the arm and away from the second surface. When each of the first and second actuators are in the first position, the projection on the first actuator is disposed between the first housing and the projection defined by the second actuator. This structural arrangement provides a mechanism for moving the first and second actuators in tandem, or together. For example, in these embodiments, when a first housing is in the first position a force applied on the first actuator to move it from the first position to the second position also moves the second actuator from the first position to the second position. In addition, in these embodiments, when a first housing is in the first position a force applied on the second actuator to move it from the second position to the first position also moves the first actuator from the second position to the first position.

The hinge 24 comprises a first pin 240, a second pin 242, an elongate member 250, a plurality of attachment members 252, and a plurality of set screws 254.

The first pin 240 and has a threaded portion that is sized and configured to mate with the threads defined by the first aperture of the plurality of apertures 158 defined by the third member 132. The second pin 242 and has a threaded portion that is sized and configured to mate with the threads defined by the second aperture of the plurality of apertures 158 defined by the third member 132. The first pin 240 is disposed through the first aperture of the plurality of apertures 158 defined by the third member 132. The second pin 242 is disposed through the second aperture of the plurality of apertures 158 defined by the third member 132. Each of the first pin 240 and second pin 242 has a length that is greater than the length of the first aperture and the second aperture of the plurality of apertures 158.

The elongate member 250 has a first end 256, a second end 258, a first surface 260, a second surface 262, and a body 264 that defines a first recess 266, a second recess 268, a first plurality of apertures 270, and a second plurality of apertures 272. Each of the first recess 266 and the second recess 268 extends from the first surface 260 and toward the second surface 262 and is sized and configured to receive a portion of a pin (e.g., first pin 240, second pin 242). Each aperture of the first plurality of apertures 270 extends through the body 264 of the elongate member 250 and is sized and configured to receive an attachment member of the plurality of attachment members 252. Each aperture of the first plurality of apertures 270 is disposed between the first recess 266 and the second recess 268.

Each aperture of the second plurality of apertures 272 is sized and configured to receive a set screw of the plurality of set screws 254. A first aperture of the second plurality of apertures 272 is disposed between the first end 256 and the first plurality of apertures 270 and extends from the base of the first recess 266 to the second surface 262. A second aperture of the second plurality of apertures 272 is disposed between the second end 258 and the first plurality of apertures 270 and extends from the base of the second recess 268 to the second surface 262.

After the first pin 240 and the second pin 242 have been positioned in the second housing 18, the first housing 12 is positioned on the second housing 18 such that the second surface 74 of the second member 34 contacts the first surface 142 of the third member 132. During this step a portion of the first pin 240 and a portion of the second pin 242 are positioned within a notch of the plurality of notches 86 defined by the second member 34. Subsequently, the elongate member 250 is positioned on the second projection 84 of the second member 34 such that the first surface 260 of the elongate member 250 contacts the second projection 84. During this step a portion of the first pin 240 is disposed within the first recess 266 of the elongate member 240 and a portion of the second pin 242 is positioned within the second recess 268 of the elongate member 240. To releasably attach the elongate member 250 to the first housing 12 each of the plurality of attachment members 252 is passed through an aperture of the first plurality of apertures 270 defined by the elongate member 250 and into an aperture of the plurality of apertures 88 defined by the first housing 12.

To adjust the positioning of the first housing 12 relative to the second housing 18, each set screw of the plurality of set screws 254 is positioned within an aperture of the second plurality of apertures 272. The depth in which each set screw is positioned within an aperture of the second plurality of apertures 272 determines how the first housing 12 can be manipulated relative to the second housing 18. For example, if each set screw of the plurality of set screws 254 is advanced into an aperture of the plurality of second apertures such that it contacts, or is positioned near, the first pin 240 and/or second pin 242, the first housing 12 can move between a first position and a second position relative to the second housing 18. In these embodiments, the first housing 12 can rotate relative to the second housing 18 such that the capsule filling system 10 moves between a closed configuration when the first housing 12 is in the first position and an open configuration when the first housing 12 is in the second position. A force applied to the first end 38 of the first member 32 away from the second housing 18 and toward the second end 40 of the first member 32 moves the first housing 12 from the first position to the second position. A force applied to the first member 32 toward the second housing 18 and away from the second end 40 of the first member 32 moves the first housing 12 from the second position to the first position.

Alternatively, if each set screw of the plurality of set screws 254 is advanced into an aperture of the plurality of second apertures such that a gap is disposed between the end of the set screw and the first pin 240 and/or second pin 242, the first housing 12 can move between a first position, a second position, and a third position relative to the second housing 18. In these embodiments, the first housing 12 can be moved from a first position to a second position by applying an axial force on the first housing 12 and away from the second housing 18 such that the first housing 12 is separated from the second housing 18. Subsequently, the first housing 12 can rotate relative to the second housing 18 and from the second position to the third position such that the capsule filling system 10 moves from a closed configuration in which the first housing 12 is positioned over the second housing 18 to an open configuration. A force applied to the first member 32 away from the second housing 18 and toward the second end 40 of the first member 32 moves the first housing 12 from the second position to the third position. A force applied to the first member 32 toward the second housing 18 and away from the second end 40 of the first member 32 moves the first housing 12 from the third position to the second position. A force applied on the first housing 12 axially toward the second housing 18 moves the first housing 12 from the second position to the first position.

While a particular structural configuration of a hinge 26 has been illustrated, a hinge included in a capsule filling system can comprise any suitable structural arrangement and be based on various considerations, such as the structural arrangement of the first housing and/or second housing. Example hinges considered suitable to include on a capsule filling system include butt hinges, barrel hinges, flush hinges, hinges in which both leaves are half swaged, hinges in which one leaf is half swaged, hinges in which one leaf is swaged the full diameter of an associated pin, hinges that are formed as part of the first housing and/or second housing, and any other hinge considered suitable for a particular embodiment.

The hinge 24, and the components forming the hinge 24, can be formed of any suitable material and using any suitable manufacturing technique. Selection of a suitable material to form a hinge, and the components that form a hinge, and/or selection of a suitable manufacturing technique can be based on various considerations, including the material(s) that forms a first housing and/or second housing. Example materials considered suitable to form a hinge, and the components that form a hinge, include metals such as stainless steel, titanium, polymers, polyethylene, polyvinyl chloride, polystyrene, and any other material considered suitable for a particular embodiment. Example techniques considered suitable to form a hinge, and the components that form a hinge, include injection molding, casting, and any other technique considered suitable for a particular embodiment. In the illustrated embodiment, the hinge is formed of a metal.

Each attachment member 125, each attachment member of the plurality of attachment members 252, and each set screw of the plurality of set screws 254 can comprise any suitable structure and be formed of any suitable material. Selection of a suitable attachment member and/or set screw can be based on various considerations, such as the material (s) that form a first housing and/or second housing. Example structures considered suitable for an attachment member and/or a set screw include screws, bolts, threaded members, structures that provide a snap fit attachment between an attachment member and another component, structures that provide a friction fit attachment between an attachment member and another component, structures that provide a snap fit attachment between a set screw and another component, structures that provide a friction fit attachment between a set screw and another component, and any other structure considered suitable for a particular embodiment.

Figure 17:
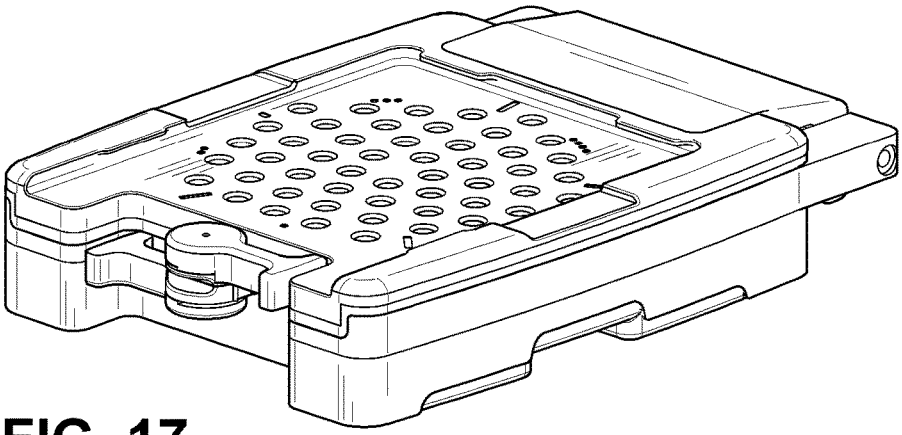
FIG. 17 illustrates a capsule disposed within the capsule filling system illustrated in FIG. 12. The first housing is in a first position, the first actuator is in a first position, and the second actuator is in a second position. The lid of the capsule filling system has been removed and the base is in a second position.
Figure 19:
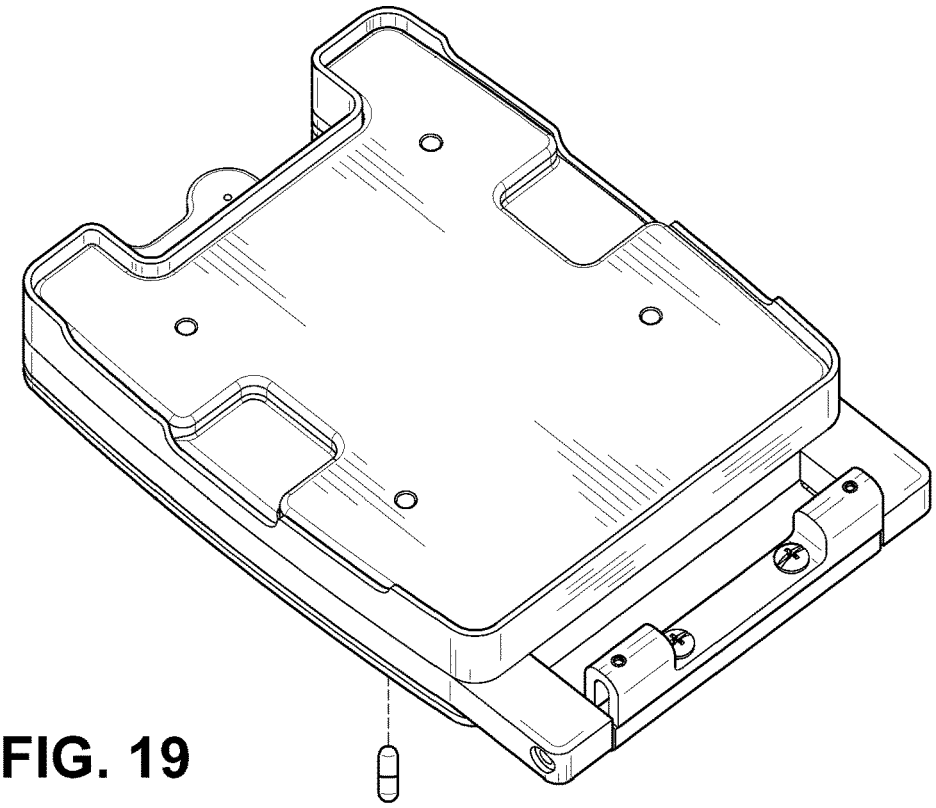
FIG. 19 illustrates a capsule being removed from the capsule filling system illustrated in FIG. 12. The first housing is in a first position and each of the first actuator and the second actuator is in a first position. The lid of the capsule filling system has been removed and the base is in a third position.

The base 26 is moveably attached to the second housing 18 and has a first end 276, a second end 278, a first surface 280, a second surface 282, and a body 284 that defines a lip 286, a first plurality of projections 288, a second plurality of projections 290, and a plurality of apertures 292. The base 26 is moveable between a first position, as shown in FIG. 1, a second position, as shown in FIG. 17, and a third position, as shown in FIG. 19.

In the illustrated embodiment, the lip 286 extends from the first surface 280 and away from the second surface 282 to define a first shoulder 296. The first shoulder 296 extends along the first surface 280 and defines a first elongated projection 298 and a second elongated projection 299. The first elongated projection 298 is sized and configured to be received by the first elongated passageway 190 defined by the third member 134 and the second elongated projection 299 is sized and configured to be received by the second elongate passageway 192 defined by the third member 134.

Each projection of the first plurality of projections 288 extends from the first surface 280 and away from the second surface 282 and is sized and configured to be received by a passageway of the plurality of second housing passageways 193. Thus, each projection of the first plurality of projections 288 is sized and configured to be received by a passageway of the plurality of passageways 148 defined by the third member 132, a passageway of the plurality of passageways 182 defined by the fourth member 134, and a passageway of the plurality of passageways 203 defined by the second rotatable member 20. Each projection of the plurality of projections 288 has a length 289 that extends from a first end of the projection to the second end of the projection that is greater than the length of a passageway of the plurality of second housing passageways 193 that extends from a first opening 195 to a second opening 197 such that each projection can apply a force on a capsule during use to remove the capsule from the capsule filling system 10.

While the length 289 of each projection of the plurality of projections 288 has been illustrated as greater than the length of a passageway of the plurality of second housing passageways 193, the length of one or more projections of a plurality of projections defined by a base can be any suitable length and can be based on various considerations, such as the length of a capsule intended to be filled by a capsule filling system. Example lengths considered suitable for a projection include lengths that are less than, greater than, equal to, or substantially equal to the length of a passageway of a plurality of third member passageways, the length of a passageway of a plurality of fourth member passageways, the sum of the length of a passageway of a plurality of third member passageways and the length of a passageway of a plurality of fourth member passageways, the length of a passageway of a plurality of first housing passageways, the length of a passageway of a plurality of second housing passageways, the sum of the length of a passageway of a plurality of first housing passageways and the length of a passageway of a plurality of second housing passageways, and any other length considered suitable for a particular embodiment.

Each projection of the second plurality of projections 290 extends from the first surface 280 and away from the second surface 282 and is sized and configured to be received by the passageway 308 defined by a spring of the plurality of springs 28. An aperture of the plurality of apertures 292 extends through each projection of the second plurality of projections 290 and to the second surface 282 of the base 26. Each aperture of the plurality of apertures 292 is sized and configured to receive an attachment member 294.

Each spring of the plurality of springs 28 has a first end 302, a second end 304, and a body 306 that is coiled from the first end 302 to the second end 304 and defines a passageway 308. The passageway 308 extends from the first end 302 to the second end 304 and is sized and configured to receive a portion of a projection of the plurality of second projections 290 defined by the base 26. During assembly, a spring of the plurality of springs 28 is positioned on a projection of the second plurality of projections 290 defined by the base 26 such that a portion of the projection of the second plurality of projections 290 is disposed within the passageway 308 defined by the spring 28. Subsequently, the base 26 is positioned on the fourth member 134 such that the second end of each spring of the plurality of springs 28 is positioned within a recess of the plurality of recesses 188 defined by the fourth member 134. Once the base 26 has been positioned on the fourth member 134, an attachment member 294 is passed through each aperture of the plurality of apertures 292 defined by the base 26 and each aperture of the plurality of apertures 189 defined by the fourth member 134 to releasably attach the base 26 to the second housing 18.

Each attachment member 294 can comprise any suitable structure and be formed of any suitable material. Selection of a suitable attachment member can be based on various considerations, such as the material(s) that form a first housing and/or second housing. Example structures considered suitable for an attachment member include screws, bolts, threaded members, structures that provide a snap fit attachment between an attachment member and another component, structures that provide a friction fit attachment between an attachment member and another component, and any other structure considered suitable for a particular embodiment.

Each spring of the plurality of springs 28 can comprise any suitable spring, can be formed of any suitable material, and can have any suitable structural arrangement. Selection of a spring to include in a capsule filling system can be based on various considerations such as the material(s) that form a first housing, second housing, and/or base. Example materials considered suitable to form a spring include metals, elastic materials, and any other material considered suitable for a particular embodiment. Example structural arrangements considered suitable for a spring include flat, round, and any other structural arrangement considered suitable for a particular embodiment.

While a plurality of springs 28 has been illustrated as included in the capsule filling system 10, any suitable number of springs can be included in a capsule filling system. The number of springs included in a capsule filling system can be based on various considerations, including the material(s) that form a first housing and/or second housing, and/or the number of projections defined by the fourth member. Example number of springs considered suitable to include in a capsule filling system include, one, at least one, two, a plurality, three, four, five, six, and any other number considered suitable for a particular embodiment. Alternative embodiments can omit a plurality of springs or include other structure capable of moving the base between first and second positions.

When the base 26 is in the first position, a first length of each projection of the first plurality of projections 288 defined by the base 26 is disposed within a passageway of the plurality of second member passageways 210. When the base 26 is in the second position, the second surface 282 of the base 26 is disposed on a plane, or near a plane, that contains the end of the lip 186 defined by the fourth member 134 and a second length of each projection of the first plurality of projections 288 defined by the base 26 is disposed within a passageway of the plurality of second member passageways 210. The first length is less than the second length. In the illustrated embodiment, the first length of each projection of the first plurality of projections 288 is equal to the length of a passageway of a plurality of second member passageways 210 less the length of a second member of a capsule (e.g., capsule body) intended to be filed using the capsule filling system 10. Alternative embodiments can include a plurality of projections on a base that have a length that positions the end of each projection of the plurality of projections at, or near, the second surface of a fourth member when the base is in the first position. The second length of each projection of the first plurality of projections 288 is equal to the first length plus the length of the second member of the capsule (e.g., capsule body) intended to be disposed within a first member of a capsule (e.g., capsule cap). Alternatively, depending on the configuration of the capsule, the second length of each projection of the first plurality of projections 288 is equal to the first length plus the length of the first member of a capsule (e.g., capsule cap) intended to be disposed within a second member of a capsule (e.g., capsule body). When the base 26 is in the third position, the second surface 282 of the base 26 is disposed between the end of the lip 186 defined by the fourth member 134 and the second surface 176 of the fourth member 134 such that a third length of each projection of the first plurality of projections 288 defined by the base 26 is disposed within a passageway of the plurality of second member passageways 210. The third length is greater than the second length.

The inclusion of a plurality of springs 28 biases the base 26 to the first position such that one or more capsules can be positioned within a passageway of the plurality of second member passageways 210 and filled, as described herein. Movement of the base 26 from the first position to the second position is accomplished by applying a force on the first housing 12 and/or second housing 18 directed toward the base 26 while maintaining the position of the base 12, by applying a force on the base 26 directed toward the second housing 18 while maintaining the position of the second housing 18, or by applying a force on the first housing 12 and/or second housing 18 directed toward the base 26 while also applying a force on the base 26 directed toward the second housing 18. Movement of the base 26 to the second position provides a mechanism for removing any capsules disposed within a passageway of the plurality of first member passageways 110 and/or a passageway of the plurality of second member passageways 210 from the capsule filling system 10.

The lid 30 has a first end 312, a second end 314, a first surface 316, a second surface 318, and a body 320 that defines a handle 322 and a plurality of projections 324. The handle 322 extends from the first surface 316 and away from the second surface 318 and is sized and configured to receive a portion of a hand of a user. Each projection of the plurality of projections 324 extends from the second surface 318 and away from the first surface 316 and is sized and configured to be received by a passageway of the plurality of first housing passageways 98 defined by the first housing 12. Each projection of the plurality of projections 324 has a length 325 that is less than the length of a passageway of the plurality of first housing passageways 98 defined by the first housing 12 such that each projection can apply a force on a first member of a capsule (e.g., capsule cap) during use to compress the first member onto a second member (e.g., capsule body). In the illustrated embodiment, the length 325 of each projection of the plurality of projections 324 is equal to the length of a passageway of a plurality of first housing passageways 98 less the length of a first member of a capsule (e.g., capsule cap) intended to be filed using the capsule filling system 10. Alternative embodiments can omit a lid or include other structure capable of performing the acts and functions of the lid described herein.

While the length 325 of each projection of the plurality of projections 324 has been illustrated as less than the length of a passageway of the plurality of first housing passageways 98, the length of one or more projections of a plurality of projections defined by a lid can be any suitable length and can be based on various considerations, such as the length of a capsule intended to be filled by a capsule filling system. Example lengths considered suitable for a projection include lengths that are less than, greater than, equal to, or substantially equal to the length of a passageway of a plurality of first member passageways, the length of a passageway of a plurality of second member passageways, and any other length considered suitable for a particular embodiment.

A capsule for use in the capsule filling system 10 can be any suitable shape, size, and configuration considered suitable for a particular embodiment and the shape, size, and configuration used in a particular embodiment can be based on various considerations, such as the material intended to be introduced into the capsule. Example shapes, sizes, and configurations considered suitable for a capsule include capsules that have a first member (e.g., cap) that is releasably attachable to a second member (e.g., capsule body), capsules that define one or more locking rings on a first member and/or second member, capsules that include one or more air vents in a first member and/or second member, capsules that include a second member that has a tapered open end to facilitate positioning within the opening defined by a first member, and any other shape, size, configuration considered suitable for a particular embodiment.

While the embodiments described herein may reduce the overall number of capsules that can be disassembled, filled, and reassembled due to the configuration of the passageways defined by the rotatable members relative to devices that utilize a sliding sheet that engages a portion of a capsule by moving horizontally along an axis that is orthogonal to an axis that extends through the thickness of the sheet, these embodiments have various advantages relative to those devices. For example, these embodiments require less working space to achieve the disassembly and reassembly of one or more capsules since each rotatable member rotates about an axis that extends through an aperture defined by the rotatable member, or the thickness of the rotatable member, rather than requiring axial movement of a sheet that increases the overall size of the device. In addition, these embodiments provide a mechanism for increasing the degree of the circumferential length of the first member (e.g., capsule cap) and/or second member (e.g., capsule body) of a capsule upon which a force is applied (e.g., by a rotatable member and housing) to releasably attach the members to a first housing and/or second housing relative to devices that use a sliding sheet that engages a portion of a capsule by moving horizontally along an axis that is orthogonal to an axis that extends through the thickness of the sheet. Furthermore, these embodiments do not require large electrical equipment to achieve the disassembly and reassembly of one or more capsules and do not require manual labor to disassemble and reassemble each capsule.

Figure 10:
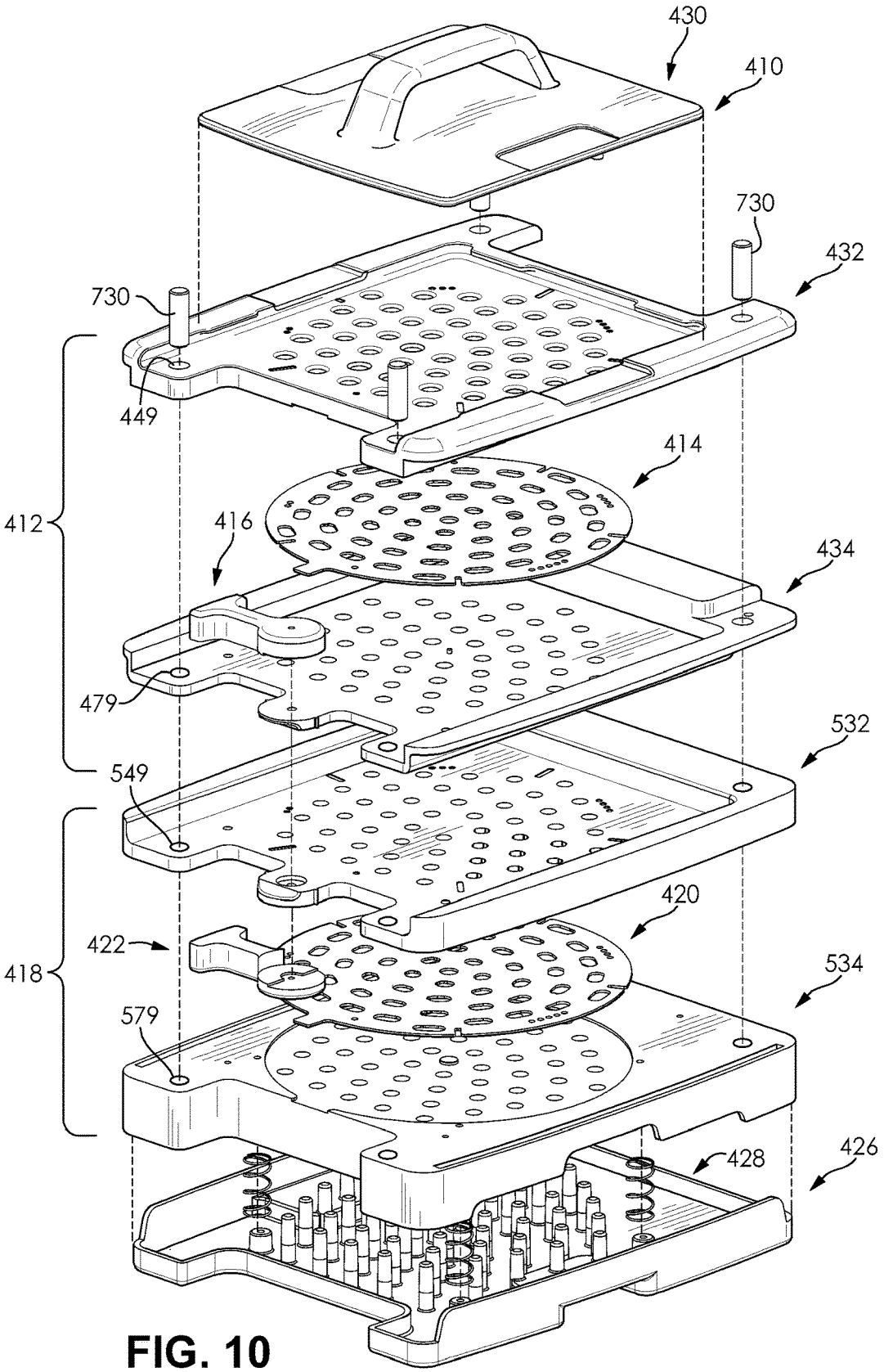
FIG. 10 is an exploded view of another example embodiment of a capsule filling system.

FIG. 10 illustrates another embodiment of a capsule filling system 410. The capsule filling system 410 is similar to the capsule filling system 10 illustrated in FIGS. 1, 2, 3, 4, 5, 6, 7, 8, 9 and described above, except as detailed below. With respect to capsule filling system 410, reference numbers in FIG. 10 refer to the same structural element or feature referenced by the same number in FIGS. 1, 2, 3, 4, 5, 6, 7, 8, and 9, offset by 400. Thus, the capsule filling system 410 has a first housing 412, first rotatable member 414, a first actuator 416, a second housing 418, a second rotatable member 420, a second actuator 422, a base 426, a plurality of springs 428, and a lid 430.

In the illustrated embodiment, the capsule filling system 410 comprises a plurality of alignment members 730. In addition, the first member 432 defines a plurality of attachment passageways 449, the second member 434 defines a plurality of attachment passageways 479, the third member 532 defines a plurality of attachment passageways 549, and the fourth member 534 defines a plurality of attachment passageways 579.

Each passageway of the plurality of attachment passageways 449, 479, 549, and 579 is sized and configured to receive a portion of the length of an alignment member of the plurality of alignment members 730. To assemble the device, the first rotatable member 414 is positioned between the first member 432 and the second member 434 and then the first member 432 is attached to the second member 434 such that the attachment passageways 449 are aligned with the attachment passageways 479. The second rotatable member 420 is positioned between the third member 532 and the fourth member 534 and then the third member 532 is attached to the fourth member 534 such that the attachment passageways 549 are aligned with the attachment passageways 579. An alignment member of the plurality of alignment members 730 is disposed within each passageway of the plurality of attachment passageways 479 defined by the second member 434 or each passageway of the plurality of attachment passageways 549 defined by the third member 532. Subsequently, the first housing 412 is positioned on the second housing 418 such that each alignment member 730 is positioned within an attachment passageway 479 or 549.

While capsule filling system 410 has been illustrated as including a plurality of alignment members 730 that are disposed through alignment apertures defined by the first member 432, second member 434, third member 532, and fourth member 534, a capsule filling system can include both the structural arrangement illustrated with respect to FIGS. 1, 2, 3, 4, 5, 6, 7, 8 and 9 and the structural arrangement illustrated in FIG. 10 such that a user can select between a hinged capsule filling system and a non-hinged capsule filling system according to the intended use of the capsule filling system.

Methods of filling a capsule using a capsule filling system are described herein. While the methods described herein are shown an described as series of acts, it is to be understood and appreciated that the methods are not limited by the order of acts described and illustrated, as some acts may in accordance with these methods, be omitted, be repeated, or occur in different orders and/or concurrently with other acts described herein. While some steps, optional steps, and/or alternative steps are exemplified by filling a capsule having a capsule cap and a capsule body, the methods, steps, optional steps, and/or alternative steps described herein can be used to fill any suitable structure that has a first member that is releasably attached to a second member. Skilled artisans will be able to select a suitable structure on which to perform the methods, steps, optional steps, and/or alternative steps described herein based on various considerations, such as the structural arrangement of a capsule intended to be filled using a capsule filling system.

Figure 11:
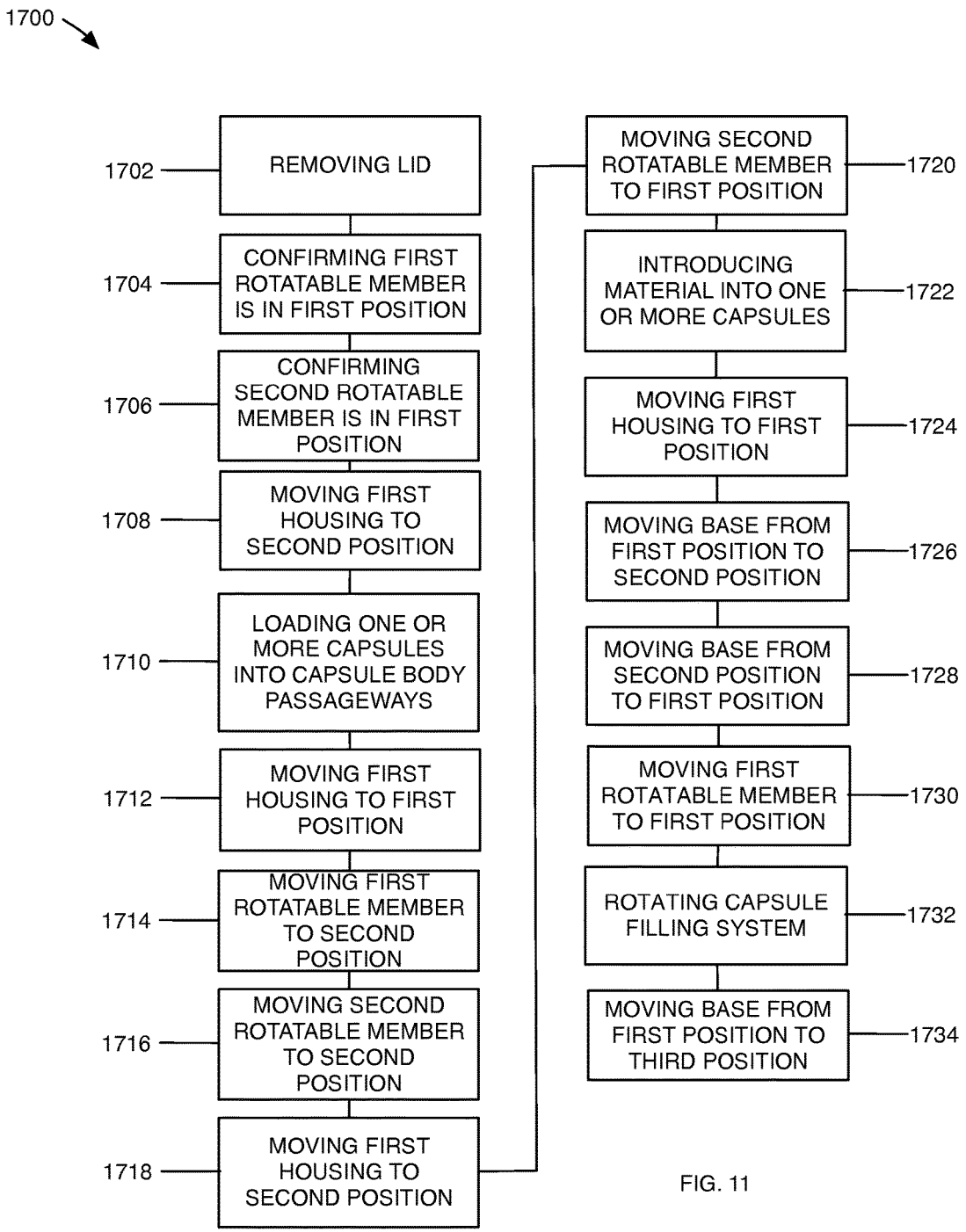
FIG. 11 is a schematic illustration of an example method of filling one or more capsules using a capsule filling system.

FIG. 11 is a schematic illustration of an example method 1700 of filling one or more capsules using a capsule filling system.

A step 1702 comprises removing the lid from the first housing. Another step 1704 comprises confirming whether the first rotatable member is in the first position. Another step 1706 comprises confirming whether the second rotatable member is in the first position. Another step 1708 comprises moving the first housing to the second position. Another step 1710 comprises loading one or more capsules into the second member passageways. Another step 1712 comprises moving the first housing to the first position. Another step 1714 comprises moving the first rotatable member to the second position to releasably attach the first member (e.g., capsule cap) of the one or more capsules to the first housing. Another step 1716 comprises moving the second rotatable member to the second position to releasably attach the second member (e.g., capsule body) of the one or more capsules to the second housing. Another step 1718 comprises moving the first housing to the second position. Another step 1720 comprises moving the second rotatable member to the first position such that the second member of the one or more capsules can fall flush with the first surface of the third member of the second housing. Another step 1722 comprises introducing a material into one or more of the second member of the one or more capsules. Another step 1724 comprises moving the first housing to the first position. Another step 1726 comprises moving the base from the first position to the second position while the first member of the one or more capsules are releasably attached to the first housing such that the second member of the one or more capsules are advanced toward the first member and are releasably attached to the first member. Another step 1728 comprises moving the base from the second position to the first position. Another step 1730 comprises moving the first rotatable member to the first position such that the caps are free of attachment to the first housing. Another step 1732 comprises rotating the capsule filling system such that the first surface of the first member is directed toward another surface (e.g., table top). Another step 1734 comprises moving the base from the first position to the third position to remove any capsules of the one or more capsules remaining in the capsule filling system.

Method 1700 can be accomplished using any suitable capsule filling system. Example capsule filling systems considered suitable to fill a capsule include capsule filling system 10, capsule filling system 410, variations of the systems described herein, and any other system considered suitable for a particular embodiment. An example capsule filling system that can be used to accomplish the methods, steps, optional steps, and/or alternative steps described herein is capsule filling system 10 and is illustrated and described with respect to FIGS. 1, 2, 3, 4, 5, 6, 7, 8 and 9. The capsule filling system 10 comprises a first housing 12, a first rotatable member 14, a first actuator 16, a second housing 18, a second rotatable member 20, a second actuator 22, a hinge 24, a base 26, a plurality of springs 28, and a lid 30.

While method 1700 has been described as a method of filling one or more capsules using a capsule filling system, any suitable number of capsules can be filled using a capsule filling system. Example number of capsules considered suitable to fill using a capsule filling system include one, at least one, two, a plurality, three, four, five, more than five, more than ten, twenty-five, fifty, one hundred, more than twenty-five, more than fifty, more than one hundred, and any other number considered suitable for a particular embodiment.

Step 1702 can be accomplished by applying an axial force directed away from the first housing 12 on any suitable portion of the lid 30 (e.g., handle 322). Optionally, step 1702 can be omitted in embodiments in which a lid is not pre-disposed on a first housing.

Step 1704 can be accomplished by visually identifying the first rotatable member or first actuator and confirming whether the first actuator is in the first position. If the first rotatable member or first actuator is not in the first position, an optional step comprises moving the first rotatable member or first actuator to the first position. Optionally, step 1704 can be omitted from method 1700.

Step 1706 can be accomplished by visually identifying the second rotatable member or second actuator and confirming whether the second rotatable member or second actuator is in the first position. If the second rotatable member or second actuator is not in the first position, an optional step comprises moving the second rotatable member or second actuator to the first position. Optionally, step 1706 can be omitted from method 1700.

Figure 12:
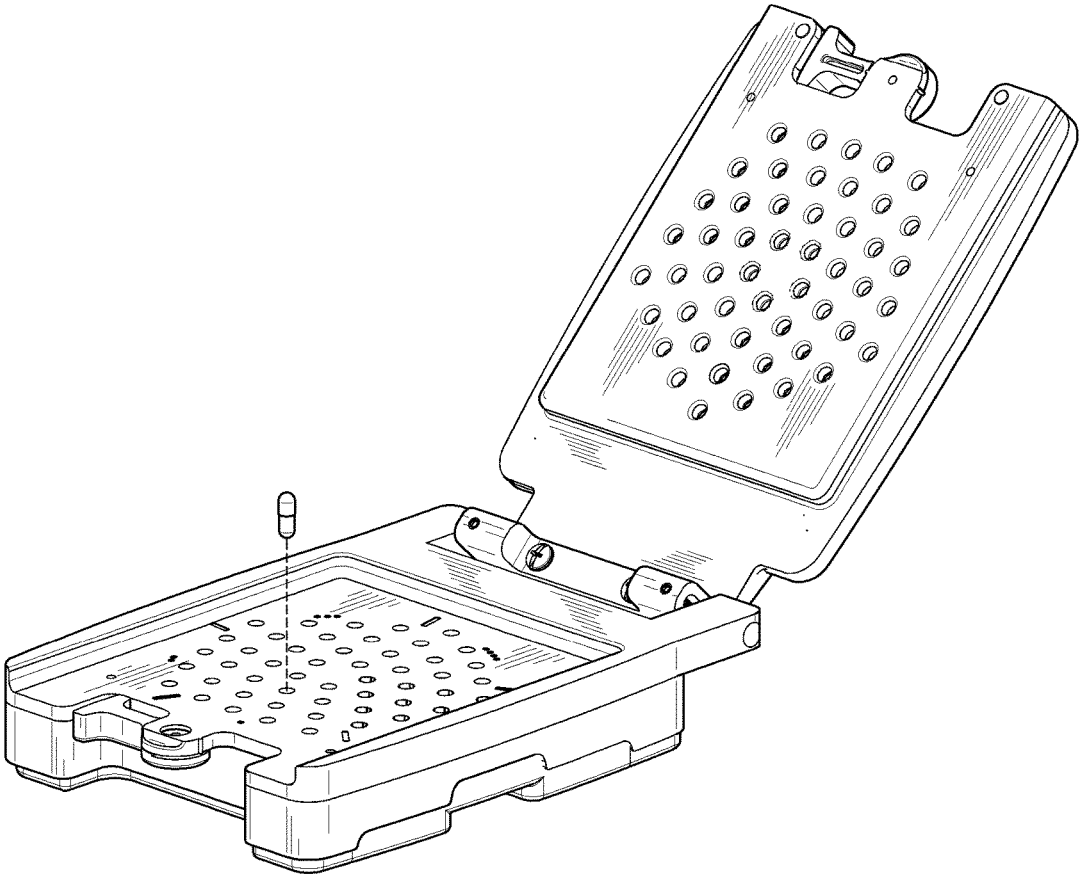
FIG. 12 illustrates a capsule being introduced into the capsule filling system illustrated in FIG. 1. The first housing is in a second position and each of the first actuator and the second actuator is in a first position.

Step 1708 can be accomplished by applying a force on the first end 38 of the first member 32 away from the second housing 18 and toward the second end 40 of the first member 32 while maintaining the position of the second housing 18. FIG. 1 illustrates the first housing 12 in the first position and FIG. 12 illustrates the first housing 12 in the second position. Alternatively, step 1708 can be accomplished by applying a force on the first end 38 of the first member 32 away from the second housing 18 and toward the second end 40 of the first member 32 while applying a force on the first end 138 of the third member 132 away from the first housing 12 and toward the second end 140 of the third member 132. Alternatively, step 1708 can be accomplished by maintaining the position of the first housing 12 while applying a force on the first end 138 of the third member 132 away from the first housing 12 and toward the second end 140 of the third member 132. Optionally step 1708 can be omitted in embodiments in which the first housing is pre-disposed in the second position.

If each set screw of the plurality of set screws 254 is advanced into an aperture of the plurality of second apertures 272 such that a gap is disposed between the end of the set screw and the first pin 240 and/or second pin 242, an alternative step comprises moving the first housing to the third position. This alternative step can be accomplished by moving the first housing 12 from the first position to the second position by applying an axial force on the first housing 12 and away from the second housing 18 while maintaining the position of the second housing 18 such that the first housing 12 is separated from the second housing 18. Alternatively, this alternative step can be accomplished by moving the first housing 12 from the first position to the second position by applying an axial force on the first housing 12 and away from the second housing 18 while applying an axial force on the second housing 18 and away from the first housing 12. A subsequent step comprises moving the first housing 12 from the second position to the third position and is accomplished by applying a force on the first housing 12 away from the second housing 18 and toward the second end 40 of the first member 32 while maintaining the position of the second housing 18. Alternatively, the step of moving the first housing from the second position to the third position can be accomplished by applying a force on the first end 38 of the first member 32 away from the second housing 18 and toward the second end 40 of the first member 32 while applying a force on the first end 138 of the third member 132 away from the first housing 12 and toward the second end 140 of the third member 132. Alternatively, the step of moving the first housing from the second position to the third position can be accomplished by maintaining the position of the first housing 12 while applying a force on the first end 138 of the third member 132 away from the first housing 12 and toward the second end 140 of the third member 132.

Step 1710 can be accomplished by applying a force on each capsule that is directed into a passageway of the plurality of second member passageways 210 such that each capsule is partially disposed within a passageway of the plurality of second member passageways 210. FIG. 12 illustrates a capsule being loaded into the capsule filling system 10. An optional step comprises confirming that the first member (e.g., capsule cap) of each capsule is contacting the first surface 142 of the third member 132.

Alternative to completing steps 1708 and 1710, an alternative step comprises loading one or more capsules into the first member passageways. This alternative step can be accomplished by applying a force on each capsule that is directed into a passageway of the plurality of first member passageways 110 such that each capsule is partially disposed within a passageway of the plurality of second member passageways 210. An optional step comprises confirming that the first member (e.g., capsule cap) of each capsule is entirely disposed within a first member passageway 110. Another optional step comprises confirming that the first member (e.g., capsule cap) of each capsule is contacting the first surface 142 of the third member 132. Another optional step comprises obtaining the lid 30. Another optional step comprises applying a force on the lid 30 directed toward the first housing 12 such that each projection of the plurality of projections 324 is disposed within a passageway of the plurality of first member passageways 110. Another step comprises continuing to apply a force on the lid 30 directed toward the first housing 12 until the second surface 318 of the lid contacts the first surface 42 of the first member 32.

Step 1712 can be accomplished by applying a force on the first end 38 of the first member 32 toward the second housing 18 and away from the second end 40 of the first member 32 while maintaining the position of the second housing 18. Alternatively, step 1712 can be accomplished by applying a force on the first end 38 of the first member 32 toward the second housing 18 and away from the second end 40 of the first member 32 while applying a force on the first end 138 of the third member 132 toward the first housing 12 and away from the second end 140 of the third member 132. Alternatively, step 1708 can be accomplished by maintaining the position of the first housing 12 while applying a force on the first end 138 of the third member 132 toward the first housing 12 and away from the second end 140 of the third member 132.

If each set screw of the plurality of set screws 254 is advanced into an aperture of the plurality of second apertures 272 such that a gap is disposed between the end of the set screw and the first pin 240 and/or second pin 242, an alternative step comprises moving the first housing from the third position to the first position. This alternative step can be accomplished by moving the first housing 12 from the third position to the second position by applying a force on the first housing 12 toward the second housing 18 and away from the second end 40 of the first member 32 while maintaining the position of the second housing 18. Alternatively, the step of moving the first housing from the third position to the second position can be accomplished by applying a force on the first end 38 of the first member 32 toward the second housing 18 and away from the second end 40 of the first member 32 while applying a force on the first end 138 of the third member 132 toward the first housing 12 and away from the second end 140 of the third member 132. Alternatively, the step of moving the first housing from the third position to the second position can be accomplished by maintaining the position of the first housing 12 while applying a force on the first end 138 of the third member 132 toward the first housing 12 and away from the second end 140 of the third member 132. A subsequent step comprises moving the first housing 12 from the second position to the first position and is accomplished by applying an axial force on the first housing 12 toward the second housing 18 while maintaining the position of the second housing 18 such that the first housing 12 is contacts the second housing 18. Alternatively, the step of moving the first housing 12 from the second position to the first position can be accomplished by applying an axial force on the first housing 12 toward the second housing 18 while applying an axial force on the second housing 18 toward the first housing 12.

Figure 13:
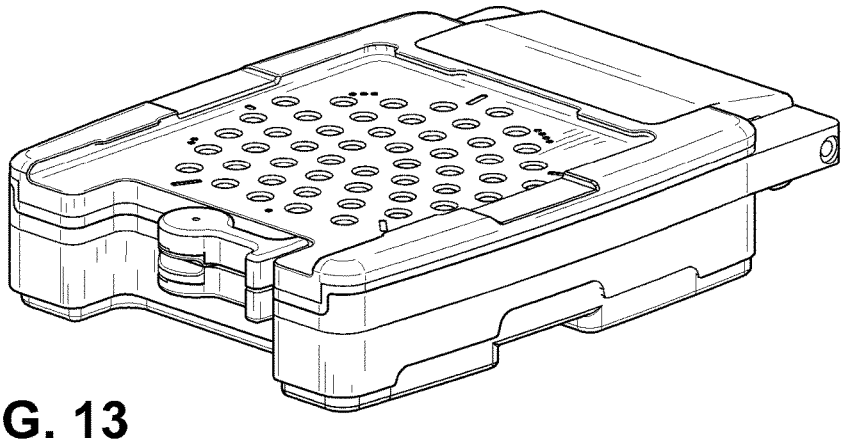
FIG. 13 illustrates a capsule disposed within the capsule filling system illustrated in FIG. 12. The first housing is in a first position and each of the first actuator and the second actuator is in a second position. The lid has been removed for clarity.

Step 1714 can be accomplished by applying a force on the first actuator 16 (e.g., arm 120) away from the first end 38 of the first member 32 and toward a first side of the first housing 12. FIG. 13 illustrates the first rotatable member 14 and the first actuator 16 in the second position.

Step 1716 can be accomplished by applying a force on the second actuator 22 (e.g., arm 220) away from the first end 138 of the third member 132 and toward a first side of the second housing 18. Step 1714 can be accomplished prior to, subsequent to, or simultaneous with, step 1716. FIG. 13 illustrates the second rotatable member 20 and the second actuator 22 in the second position.

Figure 14:
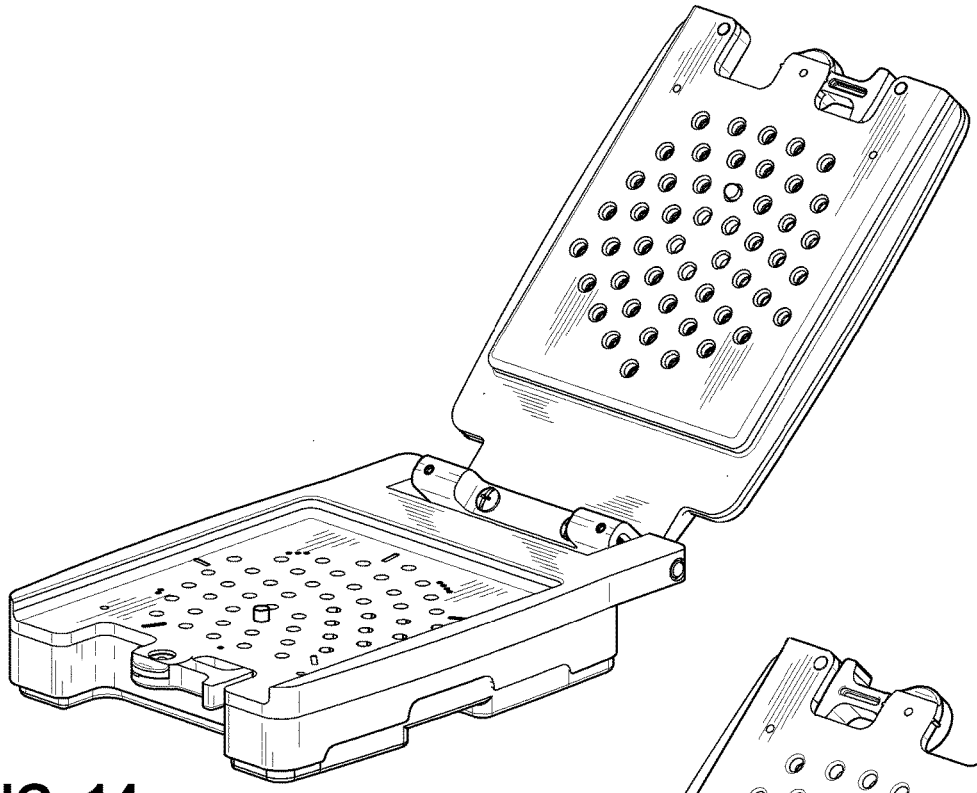
FIG. 14 illustrates a capsule disposed within the capsule filling system illustrated in FIG. 12. The first housing is in a second position and each of the first actuator and the second actuator is in a second position.

Step 1718 can be accomplished by applying a force on the first end 38 of the first member 32 away from the second housing 18 and toward the second end 40 of the first member 32 while maintaining the position of the second housing 18. FIG. 14 illustrates the first housing 12 in the second position and each of the first actuator 16 and the second actuator 22 in the second position. Alternatively, step 1718 can be accomplished by applying a force on the first end 38 of the first member 32 away from the second housing 18 and toward the second end 40 of the first member 32 while applying a force on the first end 138 of the third member 132 away from the first housing 12 and toward the second end 140 of the third member 132. Alternatively, step 1718 can be accomplished by maintaining the position of the first housing 12 while applying a force on the first end 138 of the third member 132 away from the first housing 12 and toward the second end 140 of the third member 132.

If each set screw of the plurality of set screws 254 is advanced into an aperture of the plurality of second apertures 272 such that a gap is disposed between the end of the set screw and the first pin 240 and/or second pin 242, an alternative step comprises moving the first housing to the third position. This alternative step can be accomplished by moving the first housing 12 from the first position to the second position by applying an axial force on the first housing 12 and away from the second housing 18 while maintaining the position of the second housing 18 such that the first housing 12 is separated from the second housing 18. Alternatively, this alternative step can be accomplished by moving the first housing 12 from the first position to the second position by applying an axial force on the first housing 12 and away from the second housing 18 while applying an axial force on the second housing 18 and away from the first housing 12. A subsequent step comprises moving the first housing 12 from the second position to the third position and is accomplished by applying a force on the first housing 12 away from the second housing 18 and toward the second end 40 of the first member 32 while maintaining the position of the second housing 18. Alternatively, the step of moving the first housing from the second position to the third position can be accomplished by applying a force on the first end 38 of the first member 32 away from the second housing 18 and toward the second end 40 of the first member 32 while applying a force on the first end 138 of the third member 132 away from the first housing 12 and toward the second end 140 of the third member 132. Alternatively, the step of moving the first housing from the second position to the third position can be accomplished by maintaining the position of the first housing 12 while applying a force on the first end 138 of the third member 132 away from the first housing 12 and toward the second end 140 of the third member 132.

Figure 15:
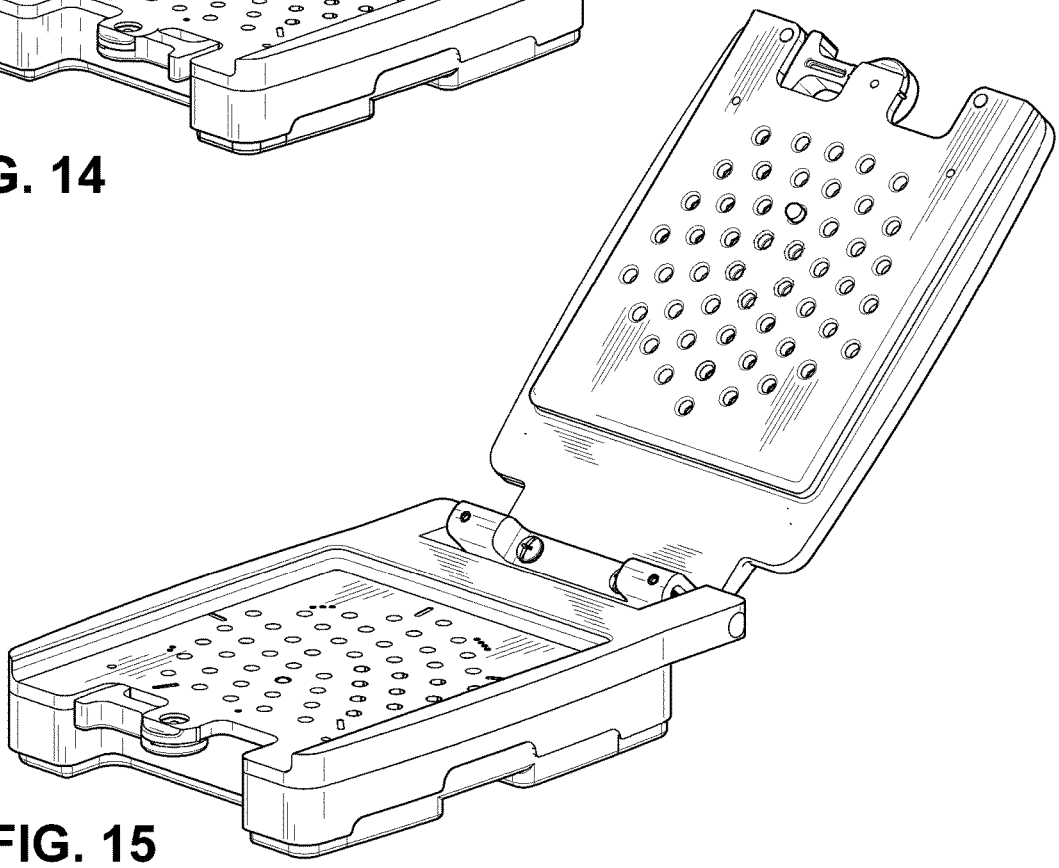
FIG. 15 illustrates a capsule disposed within the capsule filling system illustrated in FIG. 12. The first housing is in a second position, the first actuator is in a first position, and the second actuator is in a second position.

Step 1720 can be accomplished by applying a force on the second actuator 22 (e.g., arm 220) away from the first end 138 of the third member 132 and toward a second side of the second housing 18 that is substantially opposably facing the first side. FIG. 15 illustrates the first rotatable member 14 and the first actuator 16 in the second position and the second rotatable member 20 and the second actuator 22 in the first position. Optionally step 1720 can be omitted from method 1720.

An optional step that be completed after step 1720 comprises obtaining the lid 30. Another optional step comprises applying a force on the lid 30 directed toward the second housing 18 such that each projection of the plurality of projections 324 is advanced toward a passageway of the plurality of first member passageways 110. Another step comprises continuing to apply a force on the lid 30 directed toward the second housing 18 until each capsule body of the one or more capsules is flush with the first surface 142 of the third member 132.

Step 1722 can be accomplished by introducing a material into one or more of the capsule bodies of the one or more capsules until a desired amount of material has been introduced into the one or more capsule bodies. Alternatively, a material can be introduced into each capsule body of the one or more capsules. The material can be introduced into a capsule body individually, as a set, or as a whole using any suitable device or system. Any suitable material can be introduced into a capsule body and can be selected based on various considerations, including the intended use of the one or more capsules.

Figure 16:
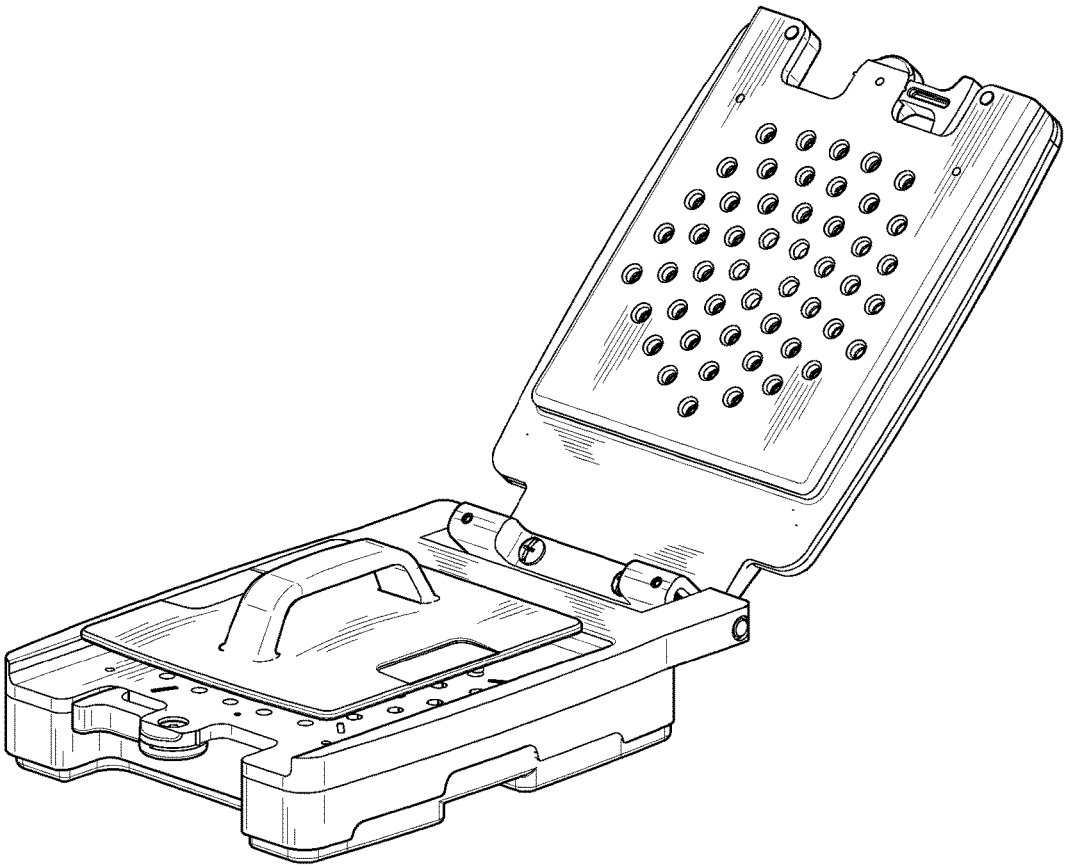
FIG. 16 illustrates a capsule disposed within the capsule filling system illustrated in FIG. 12. The first housing is in a second position, the first actuator is in a first position, and the second actuator is in a second position. The lid of the capsule filling system is positioned over the second housing.

An optional step that can be completed in combination with, or subsequent to, step 1722 comprises spreading the material on the first surface 142 of the third member 132 such that the capsule bodies are filled with the material. Another optional step that can be completed subsequent to step 1722 comprises removing excess material from the first surface 142 of the third member 132. This optional step can be accomplished by positioning, or contacting, a side of the lid 30 at, or near, the second end 140 of the third member 132 such that a side of the lid 30 contacts, or is adjacent to, the first surface 142 of the third member 132 and applying an axial force on the lid 30 in a direction toward the first end 138 of the third member 132. Another optional step that can be completed subsequent to step 1722 comprises tamping the material into the capsule bodies. This optional step can be accomplished by obtaining the lid 30. Another optional step comprises positioning the lid 30 over the second housing 18. FIG. 16 illustrates the lid 30 disposed over the second housing 18. Another optional step comprises applying a force on the lid 30 directed toward the second housing 18 such that each projection of the plurality of projections 324 is advanced toward a passageway of the plurality of second member passageways 210. Another step comprises continuing to apply a force on the lid 30 directed toward the second housing 18 until the material has been tamped into the capsule bodies.

Step 1724 can be accomplished by applying a force on the first end 38 of the first member 32 toward the second housing 18 and away from the second end 40 of the first member 32 while maintaining the position of the second housing 18. Alternatively, step 1724 can be accomplished by applying a force on the first end 38 of the first member 32 toward the second housing 18 and away from the second end 40 of the first member 32 while applying a force on the first end 138 of the third member 132 toward the first housing 12 and away from the second end 140 of the third member 132. Alternatively, step 1724 can be accomplished by maintaining the position of the first housing 12 while applying a force on the first end 138 of the third member 132 toward the first housing 12 and away from the second end 140 of the third member 132.

If each set screw of the plurality of set screws 254 is advanced into an aperture of the plurality of second apertures 272 such that a gap is disposed between the end of the set screw and the first pin 240 and/or second pin 242, an alternative step comprises moving the first housing from the third position to the first position. This alternative step can be accomplished by moving the first housing 12 from the third position to the second position by applying a force on the first housing 12 toward the second housing 18 and away from the second end 40 of the first member 32 while maintaining the position of the second housing 18. Alternatively, the step of moving the first housing from the third position to the second position can be accomplished by applying a force on the first end 38 of the first member 32 toward the second housing 18 and away from the second end 40 of the first member 32 while applying a force on the first end 138 of the third member 132 toward the first housing 12 and away from the second end 140 of the third member 132. Alternatively, the step of moving the first housing from the third position to the second position can be accomplished by maintaining the position of the first housing 12 while applying a force on the first end 138 of the third member 132 toward the first housing 12 and away from the second end 140 of the third member 132. A subsequent step comprises moving the first housing 12 from the second position to the first position and is accomplished by applying an axial force on the first housing 12 toward the second housing 18 while maintaining the position of the second housing 18 such that the first housing 12 is contacts the second housing 18. Alternatively, the step of moving the first housing 12 from the second position to the first position can be accomplished by applying an axial force on the first housing 12 toward the second housing 18 while applying an axial force on the second housing 18 toward the first housing 12.

Step 1726 can be accomplished by placing the base 26 on a surface, such as a table, and applying an axial force on the first housing 12 directed toward the base 26 until the lip 186 of the fourth member 132 contacts the surface on which the base 26 is placed. FIG. 17 illustrates the first housing 12 in the first position, the first actuator 16 in the second position, the second actuator 22 in the first position, and the base 26 in the second position. Alternatively, this step can be accomplished by maintaining the position of the first housing 12 and applying an axial force on the base 26 directed toward the first housing 12 until the base moves from the first position to the second position. Alternatively, this step can be accomplished by applying an axial force on the first housing 12 directed toward the base 26 and applying an axial force on the base 26 directed toward the first housing 12 until the base moves from the first position to the second position. An optional step that can be completed prior to step 1726 comprises obtaining the lid 30. Another optional step comprises applying a force on the lid 30 directed toward the first housing 12 such that each projection of the plurality of projections 324 is disposed within a passageway of the plurality of first member passageways 110. Another step comprises continuing to apply a force on the lid 30 directed toward the first housing 12 until the second surface 318 of the lid contacts the first surface 42 of the first member 32. These optional steps provide a mechanism for maintaining the position of the one or more capsules while the base 26 is moved from its first position to its second position. Alternatively, step 1726 can be accomplished such that the capsule bodies of the one or more capsules are advanced toward the capsule caps of the one or more capsules and a portion of a capsule cap of each of the one or more capsules is introduced into a capsule body of the one or more capsules.

Alternative to completing step 1726 while the caps are releasably attached to the first housing 12, another step comprises moving the first rotatable member 14 to the first position such that the capsules are free of attachment to the first housing 12 and then completing the step of moving the base 26 from the first position to the second position such that the capsule bodies of the one or more capsules are advanced toward the capsule caps of the one or more capsules and a portion of a capsule body of each of the one or more capsules is introduced into a capsule cap of the one or more capsules. Alternatively, these steps can be accomplished such that the capsule bodies of the one or more capsules are advanced toward the capsule caps of the one or more capsules and a portion of a capsule cap of each of the one or more capsules is introduced into a capsule body of the one or more capsules.

Step 1728 can be accomplished by removing the axial force being applied on the first housing 12 directed toward the base 26. Alternatively, this step can be accomplished by maintaining the position of the first housing 12 and removing the axial force being applied on the base 26 directed toward the first housing 12. Alternatively, this step can be accomplished by removing the axial force on the first housing 12 directed toward the base 26 and removing the axial force on the base 26 directed toward the first housing 12.

Step 1730 can be accomplished by applying a force on the first actuator 16 (e.g., arm 120) away from the first end 38 of the first member 32 and toward a first side of the first housing 12.

Figure 18:
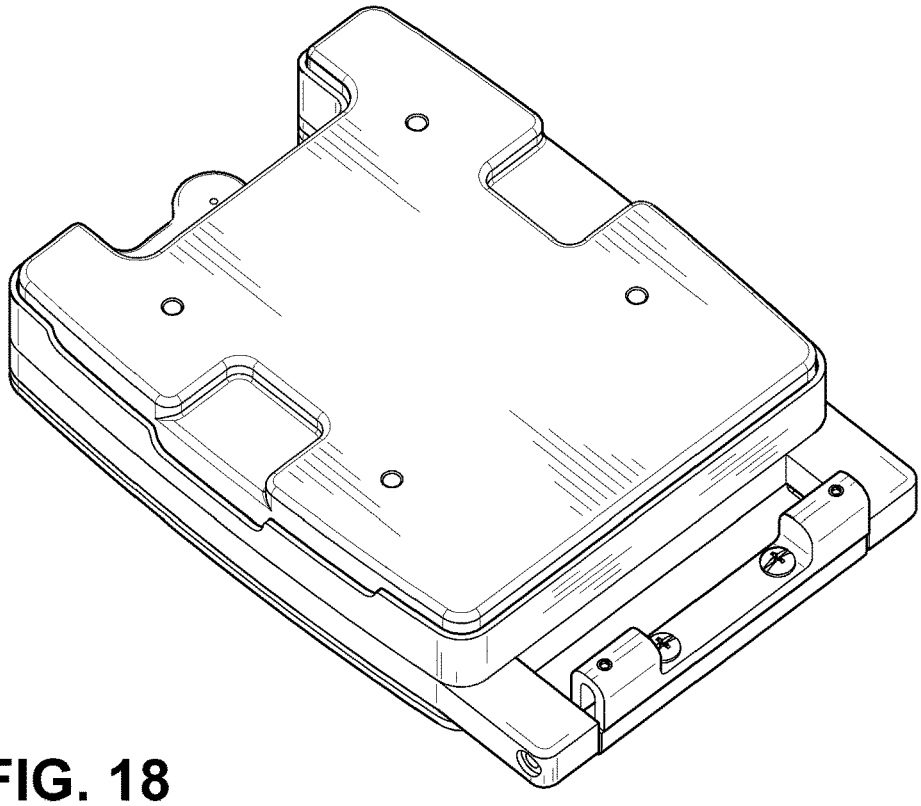
FIG. 18 illustrates a capsule disposed within the capsule filling system illustrated in FIG. 12. The first housing is in a first position and each of the first actuator and the second actuator is in a first position. The lid of the capsule filling system has been removed and the base is in a first position.

Step 1732 can be accomplished by applying a rotational force on the capsule filling system 10 on an axis that extends between the first housing 12 and the second housing 18 when the first housing 12 is in the first position such that the first surface 42 of the first member 32 is directed toward a surface 1800 that is outside of the plurality of first housing passageways 98. FIG. 18 illustrates the capsule filling system 10 directed toward a surface 1800 that is free of the capsule filling system 10. An optional step that can be completed prior to step 1732 comprises removing the lid 30 from the first housing 12 if it is positioned on the first housing 12.

Step 1734 can be accomplished by maintaining the position of the first housing 12 and applying an axial force on the base 26 directed toward the first housing 12 until the base moves from to the third position. FIG. 19 illustrates the base 26 in the third position. Alternatively, this step can be accomplished by applying an axial force on the first housing 12 directed toward the base 26 and applying an axial force on the base 26 directed toward the first housing 12 until the base moves to the third position. Alternatively, this step can be accomplished by applying an axial force on the first housing 12 directed toward the base 26 and maintaining the position of the base 26. Optionally, steps 1732 and/or 1734 can be omitted from method 1700 depending on the tolerances of the capsules being filled by capsule filling system 10. An optional step comprises moving the base 26 from the third position to the first position. This optional step can be accomplished by removing any external forces being applied to the first housing 12, second housing 18, and/or base 26.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. A capsule filling system for filling one or more capsules, the capsule filling system comprising:

a first housing defining a first housing cavity and a plurality of first housing passageways extending through the first housing and providing access to the first housing cavity;

a first rotatable member disposed within the first housing cavity and rotatably attached to the first housing, the first rotatable member defining a plurality of first rotatable member passageways extending through the first rotatable member, the first rotatable member moveable between a first position and a second position, the first rotatable member aligned with the first housing such that a first rotatable member passageway of the plurality of first rotatable member passageways is aligned with a first housing passageway of the plurality of first housing passageways to cooperatively define a first member passageway, the first member passageway having a first member passageway first diameter when the first rotatable member is in the first position and a first member passageway second diameter when the first rotatable member is in the second position, the first member passageway first diameter greater than the first member passageway second diameter;

a second housing attached to the first housing and defining a second housing cavity and a plurality of second housing passageways extending through the second housing and providing access to the second housing cavity;

a second rotatable member disposed within the second housing cavity and rotatably attached to the second housing, the second rotatable member defining a plurality of second rotatable member passageways extending through the second rotatable member, the second rotatable member moveable between a first position and a second position, the second rotatable member aligned with the second housing such that a second rotatable member passageway of the plurality of second rotatable member passageways is aligned with a second housing passageway of the plurality of second housing passageways to cooperatively define a second member passageway, the second member passageway having a second member passageway first diameter when the second rotatable member is in the first position and a second member passageway second diameter when the second rotatable member is in the second position, the second member passageway first diameter greater than the second member passageway second diameter; and a base attached to the second housing and configured to prevent a capsule of said one or more capsules from passing through the second housing passageway of the plurality of second housing passageways.

2. The capsule filling system of claim 1, wherein each passageway of the plurality of first housing passageways has a first housing passageway diameter; and wherein each passageway of the plurality of second housing passageways has a second housing passageway diameter that is less than the first housing passageway diameter.

3. The capsule filling system of claim 1, wherein the base is moveably attached to the second housing and defines a plurality of base projections, each projection of the plurality of base projections sized and configured to be received by a passageway of the plurality of second housing passageways, the base moveable between a first position in which a first base projection length of a base projection of the plurality of base projections is disposed within the second housing passageway and a second position in which a second base projection length of the base projection of the plurality of base projections is disposed within the second housing passageway, the first base projection length being less than the second base projection length.

4. The capsule filling system of claim 3, wherein the second housing passageway of the plurality of second housing passageways extends from a second housing first opening to a second housing second opening and the second housing passageway has a second housing passageway length that extends from the second housing first opening to the second housing second opening; and wherein the base projection of the plurality of base projections has a base projection first end, a base projection second end, and a base projection axial length that extends from the first end to the second end, the base projection axial length being greater than the second housing passageway length.

5. The capsule filling system of claim 3, further comprising a spring disposed between the second housing and the base, the spring biasing the base to the first position.

6. The capsule filling system of claim 1, further comprising a lid releasably attached to the first housing, the lid defining a plurality of lid projections, each projection of the plurality of lid projections sized and configured to be received by a passageway of the plurality of first housing passageways.

7. The capsule filling system of claim 6, wherein a first housing passageway of the plurality of first housing passageways has a first housing passageway length; and wherein a projection of the plurality of lid projections has a lid projection length that is less than the first housing passageway length.

8. The capsule filling system of claim 1, wherein the first housing is hingedly attached to the second housing.

9. The capsule filling system of claim 1, further comprising a first actuator attached to the first housing, the first actuator moveable between a first position and a second position such that movement of the first actuator between the first position and the second position moves the first rotatable member between its first and second positions; and further comprising a second actuator attached to the second housing, the second actuator moveable between a first position and a second position such that movement of the second actuator between the first position and the second position moves the second rotatable member between its first and second positions.

10. The capsule filling system of claim 1, wherein the first housing is formed of a first material;

wherein the first rotatable member is formed of a second material that is different than the first material.

11. The capsule filling system of claim 1, wherein each passageway of the plurality of first rotatable member passageways is oblong; and wherein each passageway of the plurality of second rotatable member passageways is oblong.

12. The capsule filling system of claim 1, wherein the first rotatable member rotates about a first rotatable member axis that extends through the first rotatable member;

wherein a first set of the plurality of first rotatable member passageways is positioned a first distance from the first rotatable member axis, each passageway of the first set of the plurality of first rotatable member passageways having a first rotatable member passageway length;

wherein a second set of the plurality of first rotatable member passageways is positioned a second distance from the first rotatable member axis, each passageway of the second set of the plurality of first rotatable member passageways having a second rotatable member passageway length, the second distance being greater than the first distance, the second rotatable member passageway length being greater than the first rotatable member passageway length.

13. A capsule filling system for filling one or more capsules, the capsule filling system comprising:

a first housing defining a first housing cavity and a plurality of first housing passageways extending through the first housing and providing access to the first housing cavity, each passageway of the plurality of first housing passageways having a first housing passageway diameter;

a first rotatable member disposed within the first housing cavity and rotatably attached to the first housing, the first rotatable member defining a plurality of first rotatable member passageways extending through the first rotatable member, the first rotatable member moveable between a first position and a second position, the first rotatable member aligned with the first housing such that a first rotatable member passageway of the plurality of first rotatable member passageways is aligned with a first housing passageway of the plurality of first housing passageways to cooperatively define a first member passageway, the first member passageway having a first member passageway first diameter when the first rotatable member is in the first position and a first member passageway second diameter when the first rotatable member is in the second position, the first member passageway first diameter greater than the first member passageway second diameter;

a second housing attached to the first housing and defining a second housing cavity and a plurality of second housing passageways extending through the second housing and providing access to the second housing cavity, each passageway of the plurality of second housing passageways having a second housing passageway diameter that is less than the first housing passageway diameter;

a second rotatable member disposed within the second housing cavity and rotatably attached to the second housing, the second rotatable member defining a plurality of second rotatable member passageways extending through the second rotatable member, the second rotatable member moveable between a first position and a second position, the second rotatable member aligned with the second housing such that a second rotatable member passageway of the plurality of second rotatable member passageways is aligned with a second housing passageway of the plurality of second housing passageways to cooperatively define a second member passageway, the second member passageway having a second member passageway first diameter when the second rotatable member is in the first position and a second member passageway second diameter when the second rotatable member is in the second position, the second member passageway first diameter greater than the second member passageway second diameter; and a base attached to the second housing and configured to prevent a capsule of said one or more capsules from passing through the second housing passageway of the plurality of second housing passageways, the base moveably attached to the second housing and defining a plurality of base projections, each projection of the plurality of base projections sized and configured to be received by a passageway of the plurality of second housing passageways, the base moveable between a first position in which a first base projection length of a base projection of the plurality of base projections is disposed within the second housing passageway and a second position in which a second base projection length of the base projection of the plurality of base projections is disposed within the second housing passageway, the first base projection length being less than the second base projection length.

14. The capsule filling system of claim 13, wherein the second housing passageway of the plurality of second housing passageways extends from a second housing first opening to a second housing second opening and the second housing passageway has a second housing passageway length that extends from the second housing first opening to the second housing second opening; and wherein the base projection of the plurality of base projections has a base projection first end, a base projection second end, and a base projection axial length that extends from the first end to the second end, the base projection axial length being greater than the second housing passageway length.

15. The capsule filling system of claim 13, further comprising a spring disposed between the second housing and the base, the spring biasing the base to the first position.

16. The capsule filling system of claim 13, wherein the first housing is hingedly attached to the second housing.

17. The capsule filling system of claim 13, further comprising a first actuator attached to the first housing, the first actuator moveable between a first position and a second position such that movement of the first actuator between the first position and the second position moves the first rotatable member between its first and second positions; and further comprising a second actuator attached to the second housing, the second actuator moveable between a first position and a second position such that movement of the second actuator between the first position and the second position moves the second rotatable member between its first and second positions.

18. The capsule filling system of claim 13, wherein each passageway of the plurality of first rotatable member passageways is oblong; and wherein each passageway of the plurality of second rotatable member passageways is oblong.

19. The capsule filling system of claim 13, wherein the first rotatable member rotates about a first rotatable member axis that extends through the first rotatable member;

wherein a first set of the plurality of first rotatable member passageways is positioned a first distance from the first rotatable member axis, each passageway of the first set of the plurality of first rotatable member passageways having a first rotatable member passageway length;

wherein a second set of the plurality of first rotatable member passageways is positioned a second distance from the first rotatable member axis, each passageway of the second set of the plurality of first rotatable member passageways having a second rotatable member passageway length, the second distance being greater than the first distance, the second rotatable member passageway length being greater than the first rotatable member passageway length.

20. A capsule filling system for filling one or more capsules, the capsule filling system comprising:

a first housing defining a first housing cavity and a plurality of first housing passageways extending through the first housing and providing access to the first housing cavity, each passageway of the plurality of first housing passageways having a first housing passageway diameter;

a first rotatable member disposed within the first housing cavity and rotatably attached to the first housing, the first rotatable member defining a plurality of oblong first rotatable member passageways extending through the first rotatable member, the first rotatable member moveable between a first position and a second position, the first rotatable member aligned with the first housing such that a first rotatable member passageway of the plurality of first rotatable member passageways is aligned with a first housing passageway of the plurality of first housing passageways to cooperatively define a first member passageway, the first member passageway having a first member passageway first diameter when the first rotatable member is in the first position and a first member passageway second diameter when the first rotatable member is in the second position, the first member passageway first diameter greater than the first member passageway second diameter;

a second housing attached to the first housing and defining a second housing cavity and a plurality of second housing passageways extending through the second housing and providing access to the second housing cavity, each passageway of the plurality of second housing passageways having a second housing passageway diameter that is less than the first housing passageway diameter;

a second rotatable member disposed within the second housing cavity and rotatably attached to the second housing, the second rotatable member defining a plurality of oblong second rotatable member passageways extending through the second rotatable member, the second rotatable member moveable between a first position and a second position, the second rotatable member aligned with the second housing such that a second rotatable member passageway of the plurality of second rotatable member passageways is aligned with a second housing passageway of the plurality of second housing passageways to cooperatively define a second member passageway, the second member passageway having a second member passageway first diameter when the second rotatable member is in the first position and a second member passageway second diameter when the second rotatable member is in the second position, the second member passageway first diameter greater than the second member passageway second diameter;

a base attached to the second housing and configured to prevent a capsule of said one or more capsules from passing through the second housing passageway of the plurality of second housing passageways, the base moveably attached to the second housing and defining a plurality of base projections, each projection of the plurality of base projections sized and configured to be received by a passageway of the plurality of second housing passageways, the base moveable between a first position in which a first base projection length of a base projection of the plurality of base projections is disposed within the second housing passageway and a second position in which a second base projection length of the base projection of the plurality of base projections is disposed within the second housing passageway, the first base projection length being less than the second base projection length; and a spring disposed between the second housing and the base, the spring biasing the base to the first position.

* * * * *